United States Patent [19]

Davis

[11] Patent Number: 4,503,554

[45] Date of Patent: Mar. 5, 1985

[54] STEREOPHONIC BALANCE CONTROL SYSTEM

[75] Inventor: Mark F. Davis, Medford, Mass.

[73] Assignee: dbx, Inc., Newton, Mass.

[21] Appl. No.: 569,498

[22] Filed: Jan. 9, 1984

Related U.S. Application Data

[62] Division of Ser. No. 500,972, Jun. 3, 1983.

[51] Int. Cl.[3] ..... H04R 5/00

[52] U.S. Cl. ..... 381/28; 381/1; 381/107

[58] Field of Search ..... 381/28, 107, 108, 102, 381/10, 120, 121, 1, 56–59; 330/295, 254, 278–281; 369/91

[56] References Cited

U.S. PATENT DOCUMENTS

| | | | |
|---|---|---|---|
| 3,195,067 | 7/1965 | Klein et al. | 381/28 X |
| 3,222,455 | 12/1965 | Golik | 381/28 |
| 3,956,709 | 5/1976 | Osakabe et al. | 381/28 X |
| 4,221,006 | 9/1980 | Weintraub et al. | 381/28 X |

*Primary Examiner*—Gene Z. Rubinson

*Assistant Examiner*—W. J. Brady

*Attorney, Agent, or Firm*—Schiller & Pandiscio

[57] ABSTRACT

The disclosure relates to an audio signal reproduction system having one or more of the following features: (1) a loudspeaker having (a) a flat frequency response and (b) a predetermined power response; (2) two loudspeakers adapted to be positioned relative to one another so that they reproduce a stereophonic image substantially independent of the listener's position along a listening line spaced from the loudspeakers and nonintersecting a line extending between the two speakers; (3) an improved cross-over network having a substantially constant input impedance as a function of frequency; (4) a power sensor for sensing the power applied to a transducer so that audio signals are transmitted over a first signal path through the system when the sensed power is above a predetermined minimum level, and over a second path when the sensed power falls below the minimum level; (5) a power monitoring circuit to prevent a loudspeaker driver from being overdriven; and (6) a circuit for substantially balancing the signal energy levels between two audio channels over a long period of time.

2 Claims, 27 Drawing Figures

WOOFER

MIDRANGE AND TWEETER

STEREOPHONIC BALANCE CONTROL SYSTEM

This application is a divisional application of my copending application Ser. No. 500,972, filed June 3, 1983, for LOUDSPEAKER SYSTEM.

The present invention relates generally to audio reproduction systems, and more particularly, to an improved audio reproduction system having one or more of the following features: (1) a loudspeaker having (a) a flat frequency response (unless described otherwise, the term "frequency response" shall be used hereinafter to refer to the frequency response of a loudspeaker in one direction) and (b) a power response (unless described otherwise, the terms "power response" shall refer to the amplitude response of a loudspeaker averaged 360° around the vertical axis of the loudspeaker in an anechoic chamber); (2) two loudspeakers adapted to be positioned relative to one another so that they reproduce a stereophonic image substantially independent of the listener's position in the listening area; (3) an improved cross-over network having a substantially constant input impedance as a function of frequency; (4) a power sensor for sensing the power applied to a transducer so that audio signals are transmitted over a first signal path through the system when the sensed power is above a predetermined minimum level, and over a second path when the sensed power falls below the minimum level; (5) a power monitoring circuit to prevent a loudspeaker driver from being overdriven; and (6) a circuit for substantially balancing the signal energy levels between two audio channels over a long period of time.

Conventional loudspeakers typically have a low frequency speaker driver (a "woofer"), a mid-frequency speaker driver and a high frequency speaker driver (a "tweeter") all mounted on a front panel of a speaker cabinet so as to radiate in the direction of a major or prime axis, the latter being adapted to be direction oriented in the directional of the listening area. These conventional loudspeakers typically exhibit radiation dispersion patterns (unless otherwise described, the term "radiation dispersion pattern" as used herein shall mean the power radiated by a speaker as a function of the angle about the vertical axis of the speaker) and frequency responses which are strongly variable functions of the horizontal angular position of the listener relative to the speaker cabinet of each loudspeaker. Generally, the lower the frequency of a sonic signal generated by the loudspeaker, the longer the wavelength and the greater angular dispersion of the sonic signal.

These conventional loudspeaker systems generally are designed so that radiation generated along the prime or major axis of radiation propagation of the loudspeaker, i.e., typically in the direction in which the speaker drivers face, oriented typically towards the listener, will be such that the on-axis frequency response is flat. However, off angle responses, i.e., positions other than on the front axis of the speaker, have an uneven frequency response. As a gross generalization it can be said that signals below about 500–600 Hz will be substantially omnidirectional becoming less so as the frequencies increase from about 20 Hz to the 500–600 Hz limit. The signals generated by the midrange drivers are substantially half omnidirectional at the lower frequency limit of about 500–600 Hz of the mid-range frequencies, while becoming less so with increasing frequencies to the upper limit of 8 Khz. The signals of the tweeter become more closely unidirectional as the frequency of the signal increases from 8 KHz to the 20 KHz.

Another approach in speaker design is to provide a power response in which the average power propagated into the listening area over all directions is substantially constant as a function of frequency. Signal attenuation averaged over all horizontal directions is therefore frequency independent. However, when the actual power radiated is measured in any one direction the power propagated can vary substantially as a function of angular position about the vertical axis of the loudspeaker.

Thus, in conventional loudspeaker designs, there is a trade-off between a flat on-axis frequency response and a flat average power response into the listening area. More recent loudspeaker designs have attempted to provide both in a single design. These designs, however, utilize relatively expensive, unusual speaker drivers (such as Walsh drivers) to make a flat on-axis frequency and flat power response simultaneously possible.

It is an object of the present invention to provide an improved loudspeaker having a substantially flat frequency response 360° around the vertical axis of the loudspeaker (which insures both a substantially flat on-axis frequency response and a substantially flat power response) and a preselected radiation dispersion pattern, without the need of utilizing unusual and costly speaker drivers.

Another object of the present invention is to provide an improved loudspeaker utilizing state of the art electromagnetic loudspeaker drivers and having a substantially flat frequency response 360° around the vertical axis of the loudspeaker and a preselected radiation dispersion pattern.

These and other objects of the present invention are achieved by a loudspeaker system comprising a plurality of loudspeaker drivers for producing sonic signals in response to electrical driving signals. Means are provided for mounting the loudspeaker drivers in a predetermined three-dimensional array with at least some of the drivers being angularly spaced with respect to one another about the vertical axis of the loudspeaker. The system also comprises means for modifying the frequency and phase responses of at least some of the loudspeaker drivers of the array so that the array of loudspeaker drivers produces in response to the electrical driving signals a combined predetermined radiation dispersion pattern and a substantially flat frequency response 360° around the vertical axis.

By modifying the frequency and phase responses of at least some of the speaker drivers of a loudspeaker so that the loudspeaker has a predetermined radiation dispersion pattern in response to electrical driving signals, it is possible to design two loudspeakers each having a predetermined radiation dispersion pattern so that when properly oriented with respect to one another the speakers can produce a stereophonic image which is substantially independent of listener position along a listening line spaced from both loudspeakers and non-intersecting with a line extending between both loudspeakers.

Accordingly, another object of the present invention is to provide a loudspeaker system comprising at least two loudspeakers each having a predetermined radiation dispersion pattern such that when properly oriented with respect to one another they can produce a stereophonic image substantially independent of listener position along a listening line spaced from both loudspeakers and non-intersecting with a line extending between the two loudspeakers.

This and other objects of the present invention are achieved by a loudspeaker system for reproducing a stereophonic image within a predefined space such that the perception of the image by the listener is substantially independent of the listener's position along a listening line spaced from the two loudspeakers and non-intersecting with a line extending between the two loudspeakers. The loudspeaker system comprises at least two loudspeakers. Each loudspeaker includes (1) a plurality of loudspeaker drivers for producing sonic signals in response to electrical driving signals, (2) means for mounting the loudspeaker drivers in a predetermined three-dimensional array with at least some of the loudspeaker drivers of the array being angularly spaced with respect to one another about the vertical axis of the loudspeaker and (3) means for modifying the frequency and phase responses of at least some of the loudspeaker drivers of the array so that the array of loudspeaker drivers produces a combined predetermined power dispersion pattern and a substantially flat frequency response at all positions around the verical axis in response to the electrical driving signals. The radiation dispersion patterns of the two loudspeakers complement one another when the loudspeakers are in a mutually preselected orientation with respect to one another so that the loudspeakers reproduce the stereophonic image in response to the electrical driving signals substantially independent of the listener's position within the predefined space along a listening line spaced from the loudspeakers and non-intersecting a line extending between the two loudspeakers.

Another problem encountered in loudspeaker systems, is that the systems typically exhibit relatively large variations in input impedance as a function of frequency which many claim can adversely affect power amplifier performance. Some manufacturers of the more expensive power amplifiers have therefore claimed that their amplifiers are adapted to deal with these non-ideal loads, and thus are usable with any loudspeaker system.

Accordingly, it is another object of the present invention to provide an improved loudspeaker system that can be utilized with substantially any amplifier of sufficient power.

It is yet another object of the present invention to provide an improved cross-over network for use in a loudspeaker system and having a substantially flat input impedance as a function of frequency.

These and other objects of the present invention are provided by an improved loudspeaker system comprising an input terminal for receiving an electrical input signal; at least two transducer means, the first of the transducer means for producing sonic signals within a relatively low frequency range in response to electrical driving signals within that range, and the second of the transducer means for producing sonic signals within a relatively high frequency range in response to electrical driving signals within that range; and cross-over network means connected between the input terminal and each of the first and second transducer means for respectively providing to the first and second transducer means the electrical driving signals within the low frequency range and high frequency range in response to the electrical input signal. The input impedance of the cross-over network means when coupled to the first and second transducer means is substantially constant throughout the low and high frequency ranges.

Utilizing such a cross-over network coupled to two transducer means, however, will result in a frequency response which is non-flat. Accordingly, it is preferable to utilize means, such as an equalizer circuit in front of the power amplifier to complement the cross-over network to provide a flat frequency response. However, should it be desirable to listen to the program signal through other means, such as headphones, the equalizer circuit will no longer be necessary.

It therefore is another object of the present invention to provide an improved audio signal processing system in which the signal path through the compensating means, such as a compensating equalization circuit, is automatically by-passed and the audio signal transmitted over another signal path when the power applied to any device for receiving audio signals from the processing system drops below a predetermined level, as for example, when the device is disconnected.

These and other objects of the present invention are achieved by an audio signal processing system for use with at least one device for receiving audio signals. The system comprises an input terminal for receiving an input signal, an output terminal for coupling the system to the input of the device, a first signal path, and a second signal path. Means are connected in the first signal path for processing said audio signal. The system also comprises means for sensing the signal energy within at least one predetermined frequency range at the input of the device and for coupling the first signal path to the input and output terminals when the signal energy is above a predetermined level and for coupling the second signal path to the input and output terminals when the signal energy is below the predetermined level.

Another problem associated with loudspeaker systems relates to the power limitations of most speaker drivers, particularly mid-range drivers and tweeters, which tend to be more fragile than woofers of the same quality level. Overdriving such speakers can result in permanent damage.

Accordingly, another object of the present invention is to provide a circuit for use in a loudspeaker system for monitoring the power transmitted to a an audio device for processing audio signals, such as a loudspeaker.

Yet another object of the present invention is to provide a power monitoring circuit for preventing speaker drivers of a loudspeaker system from being overdriven.

Still another object of the present invention is to provide a power monitoring circuit for monitoring mid and high frequency signal energy used for normally driving mid-range and tweeter speaker drivers and for reducing the power transmitted to the speaker drivers of the loudspeaker system when the signal energy exceeds a predetermined level.

And yet another object of the present invention is to provide a power monitoring circuit for monitoring the average signal energy in each of two audio channels adapted to be respectively coupled to at least two loudspeakers so that the power transmitted to either loudspeaker will not exceed a predetermined level and the loudspeaker drivers will not be overdriven.

These and other objects are achieved by a circuit for monitoring the power at least within a predetermined frequency range of an electrical information signal applied to the input of a transducer of an audio reproduction system in response to a audio input signal transmitted over a signal path of the circuit. The circuit comprises the signal path, the signal path having an input terminal for receiving the input signal and an output terminal for coupling the circuit to the transducer; means capable of being coupled to the input of the transducer for detecting the level of the power of the information signal within the predetermined frequency range and for varying the gain impressed on the input signal in response to and as a function of the detected power level.

Yet another problem associated with loudspeaker systems, and in particular, stereophonic systems, relates to the long term power balance between stereophonic signals transmitted over two stereophonic channels. For example, differential gain between the two channels may vary from recording to recording, or along the length of an audio recording tape. This can be particularly critical when one considers that a precondition of producing a stereophonic image is that two loudspeakers should produce substantially balanced power outputs, i.e. the power responses of the speakers should be substantially the same.

Accordingly, another object of the present invention is to provide a signal processing system of the type for use with a loudspeaker system for creating stereophonic sound in which the signal energy transmitted over the two stereophonic channels is substantially balanced over relatively long periods of time.

Another object of the present invention is to provide a signal processing system for comparing the average power levels in each of two stereophonic channels of a stereophonic audio reproduction system and for adjusting the power levels so they are balanced over long periods of time.

These and other objects are acheived by an improved signal processing system of the type for use with an audio reproduction system including at least two transducers for creating stereophonic sound in response to two audio input signals. The signal processing system comprises a pair of signal paths for respectively transmitting the two audio input signals to the corresponding transducers, each of the signal paths including an input terminal for receiving a respective one of the audio input signals and an output terminal for coupling the signal path to a corresponding one of the transducers. Means are coupled to each of the input terminals for detecting the signal energy level of the corresponding audio input signal. Means are provided for comparing the detected signal energy levels of the audio input signals and for generating a difference signal in response to and as a function of the comparison. The signal processing system also comprises means responsive to the difference signal and coupled between the input and output terminals of at least one of the signal paths for varying the signal gain impressed on the audio input signal transmitted over the at least one path as a function of the difference signal so that the signal energy levels of the audio input signals for the paths are substantially balanced over relatively long periods of time.

Other objects will in part be obvious and will in part appear hereinafter. The invention accordingly comprises the apparatus possessing the construction, combination of elements, and arrangement of parts which are exemplified in the following detailed disclosure, and the scope of the application of which will be indicated in the claims.

Since certain changes may be made in the above apparatus without departing from the scope of the invention herein involved, it is intended that all matter contained in the above description and shown in the accompanying drawing shall be interpreted in an illustrative and not in a limiting sense.

In the drawings the same numerals are used to refer to like parts.

Figure 1:
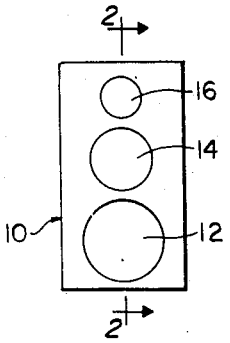
FIG. 1 PRIOR ART
FIG. 1 shows the front view of a typical prior art loudspeaker having a woofer, a mid-range frequency speaker and a tweeter.
Figure 2:
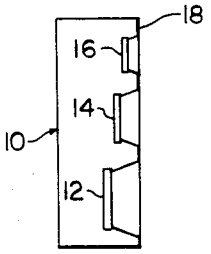
FIG. 2 PRIOR ART
FIG. 2 shows a cross-sectional view taken along line 2—2 in FIG. 1.
Figure 3:
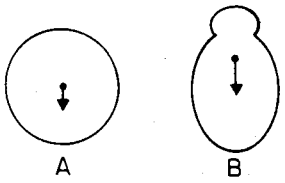
FIG. 3 PRIOR ART
Figure 4:
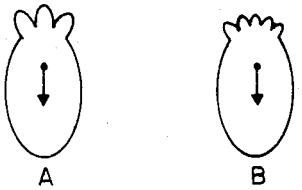
FIG. 4 PRIOR ART
Figure 5:
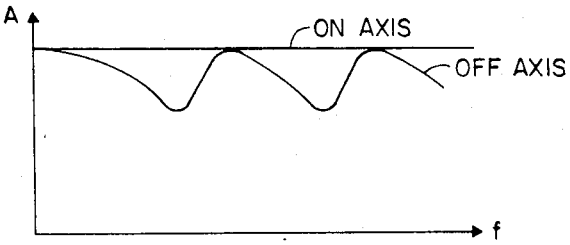
FIG. 5 PRIOR ART
Figure 6:
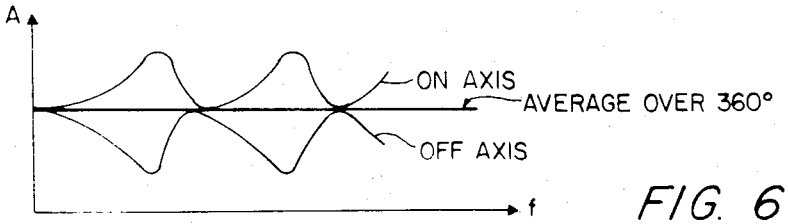
FIG. 6 PRIOR ART
Figure 7:
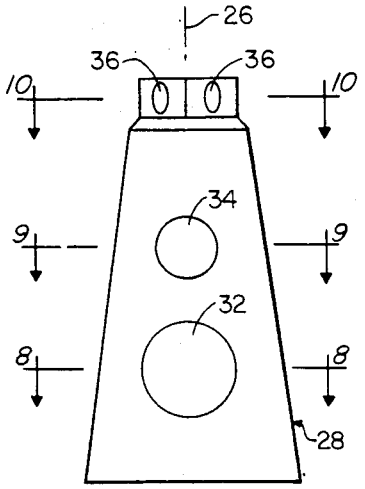
Figure 8:
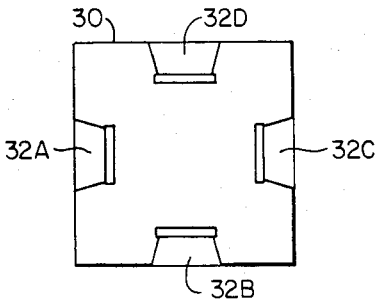
Figure 9:
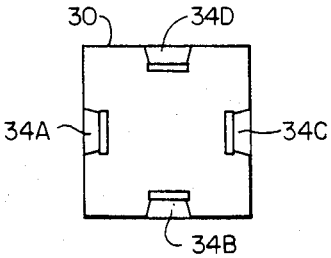
Figure 10:
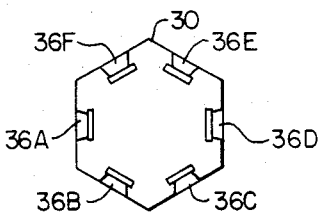
Figure 11:
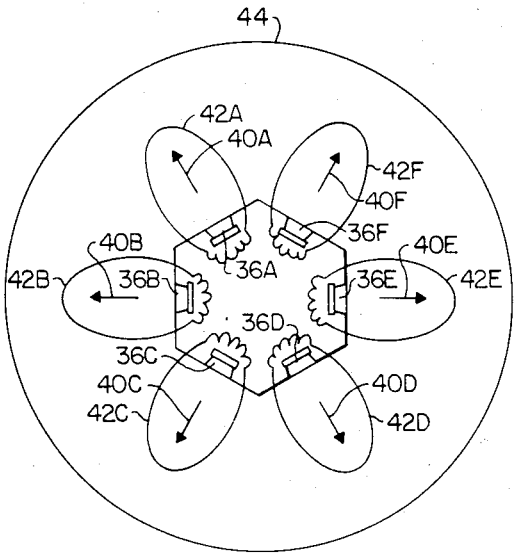
Figure 12:
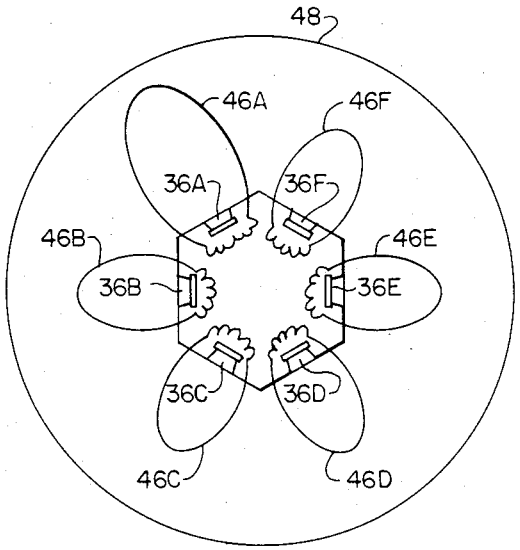
Figure 13:
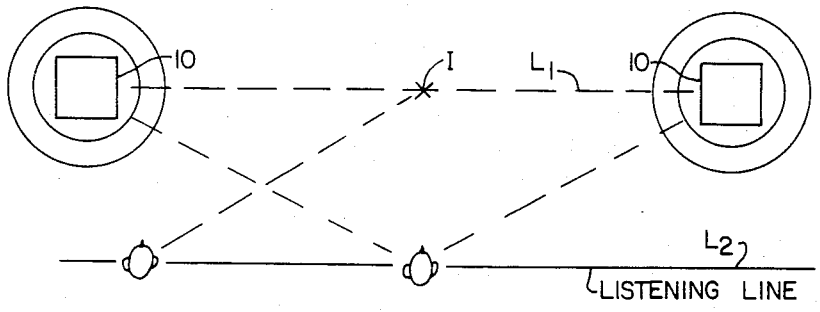
FIG. 13 PRIOR ART
Figure 14:
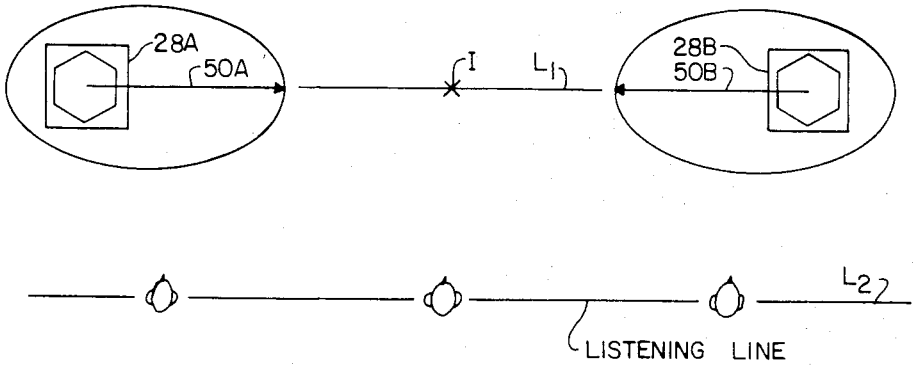
Figure 15A:
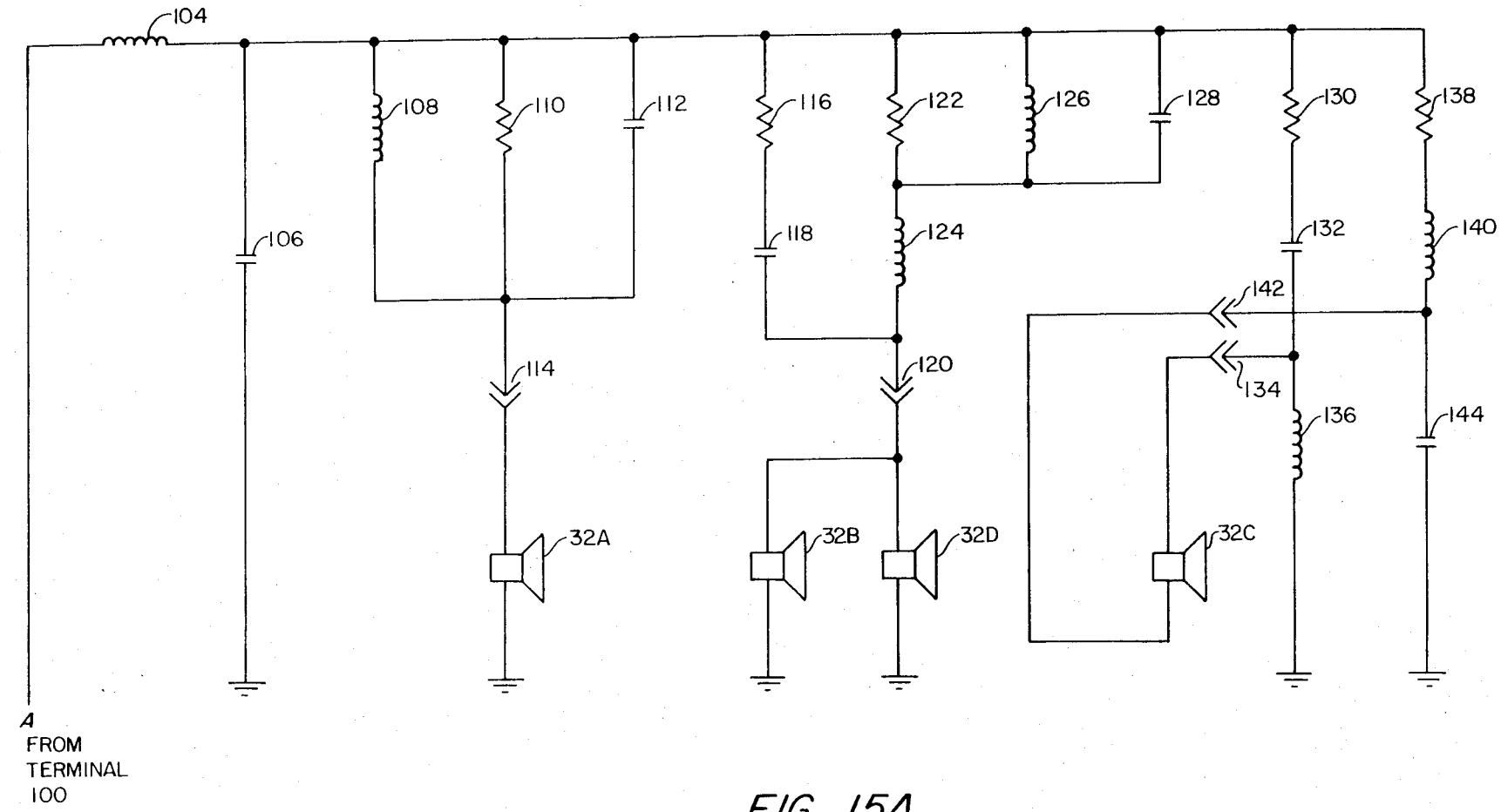
Figure 15B:
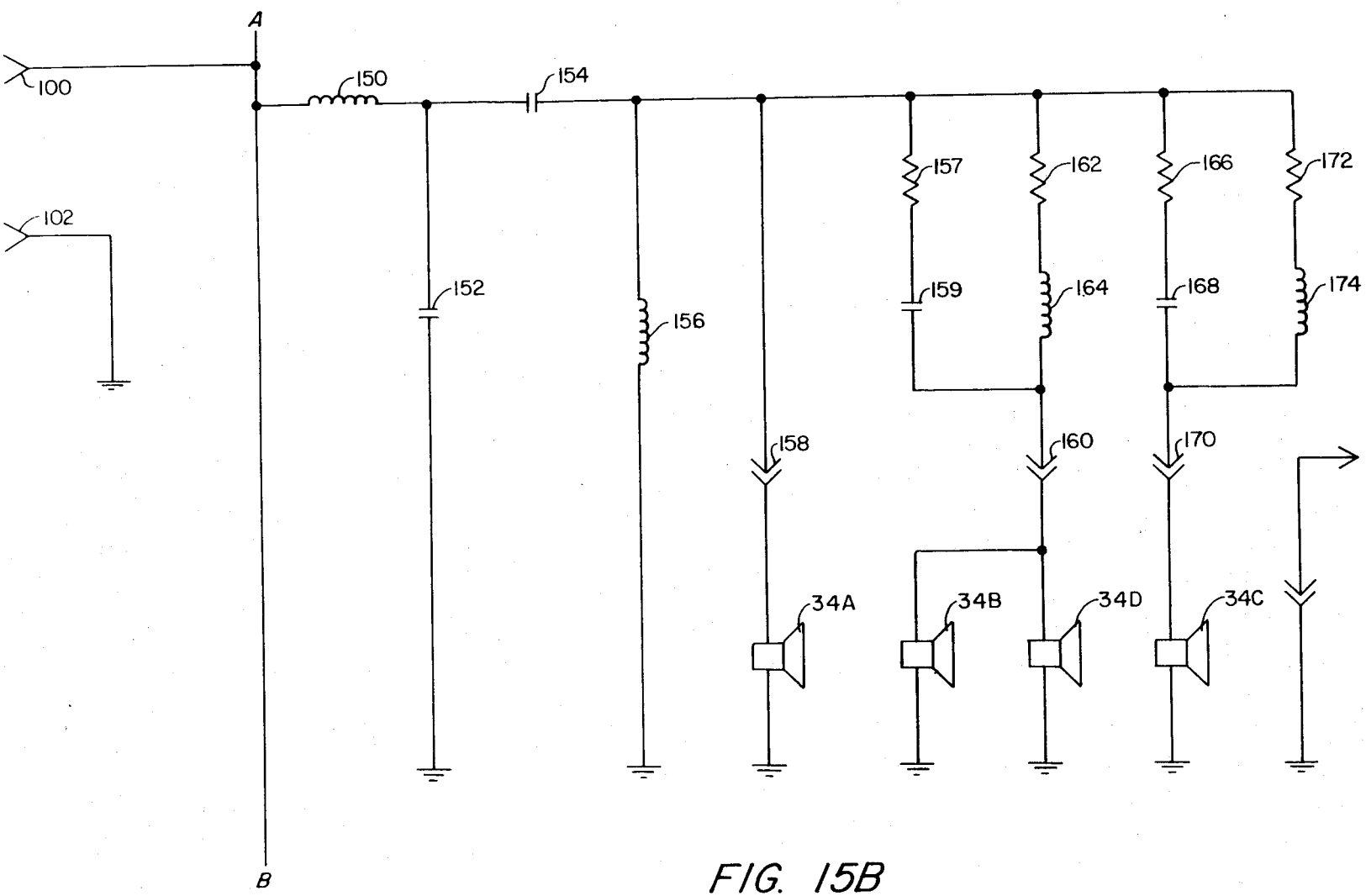
Figure 15C:
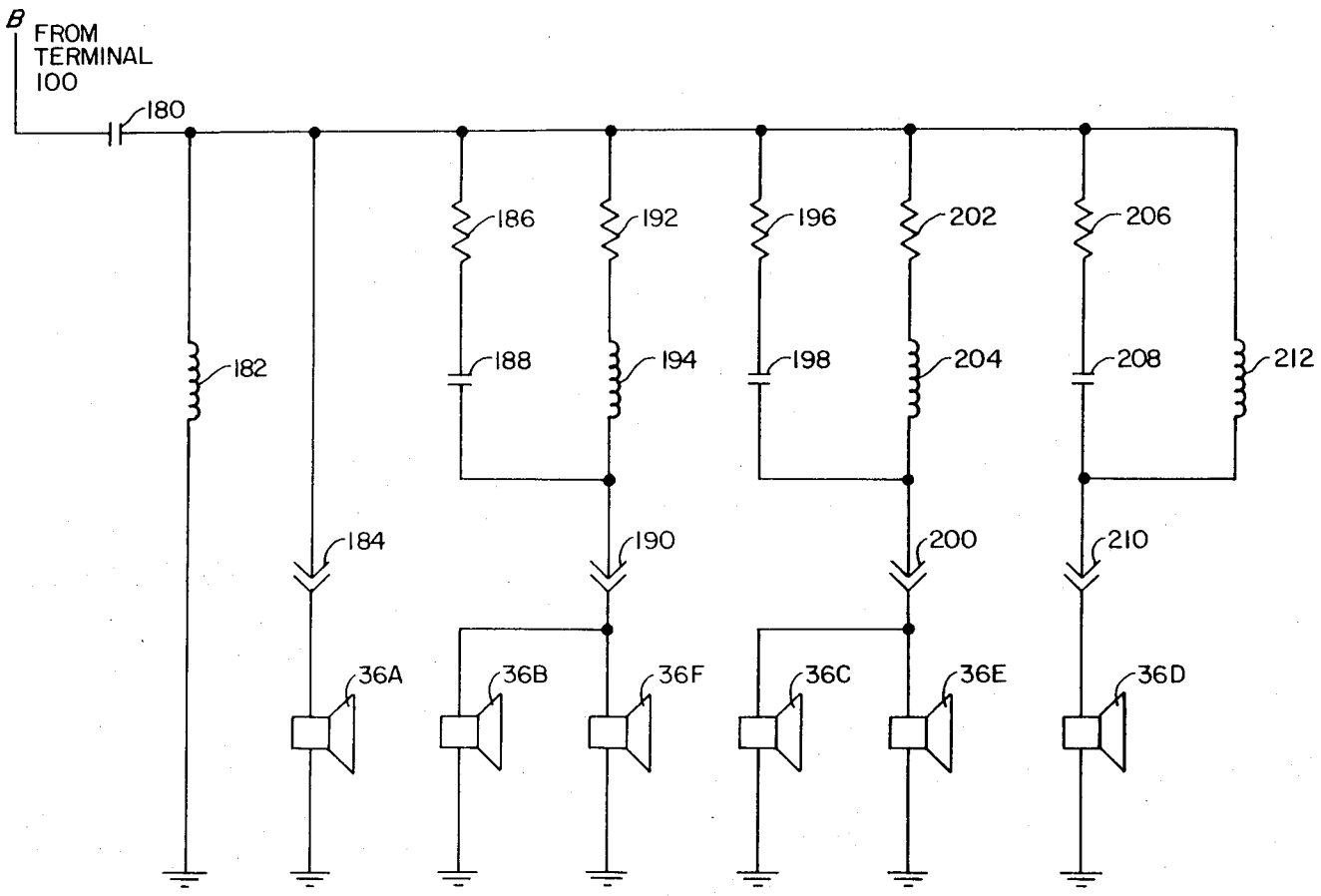
Figure 16:
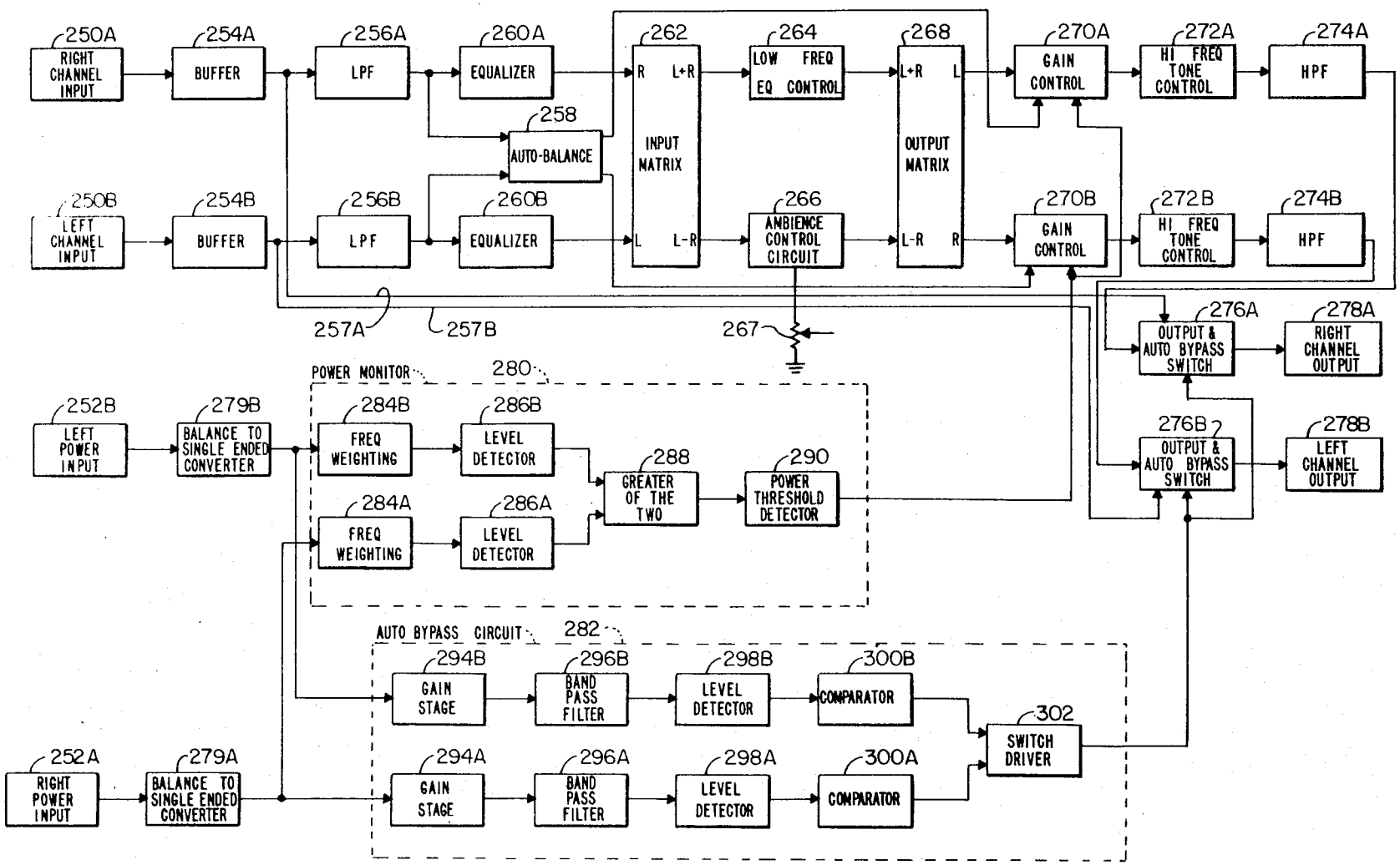

FIGS. 3A and 3B respectively show a simplified radiation dispersion pattern at two different frequencies for a typical woofer;

FIGS. 4A and 4B respectively show typical radiat-1on dispersion patterns at two different frequencies for a typical mid-range speaker and a typical tweeter;

FIG. 5 graphically illustrates the power output of a typical prior art loudspeaker, such as shown in FIGS. 1 and 2, as a function of frequency wherein the on-axis frequency response is constant;

FIG. 6 graphically illustrates a simplified plot of the power output of a loudspeaker as a function of frequency so that the power output is substantially constant;

FIG. 7 shows a front view of a preferred embodiment of a loudspeaker made in accordance with the present invention;

FIG. 8 is a cross-sectional view taken through the woofers taken along line 8—8 in FIG. 7;

FIG. 9 is a cross-sectional view taken through the mid-range speaker drivers along line 9—9 in FIG. 7;

FIG. 10 is a cross-sectional view taken through the tweeters along line 10—10 in FIG. 7;

FIG. 11 is designed to show typical radiation dispersion pattern of the tweeters of the preferred embodiment of the present invention at relatively high frequencies;

FIG. 12 shows the radiation dispersion pattern of the tweeters of the preferred embodiment of the present invention at relatively low frequencies;

FIG. 13 shows a plan view of a stereophonic loudspeaker system of the prior art to illustrate the concept of stereophonic imaging and the problems of the prior art;

FIG. 14 is a plan view of a loudspeaker system including at least two speakers for creating a stereophonic image substantially independent of listener position along the listening line;

FIGS. 15A–15C is a schematic diagram of the preferred embodiment of the cross-over network utilized in the preseht invention;

FIG. 16 shows a block diagram of the preferred embodiment of an audio reproduction system incorporating many novel aspects of the present invention; and FIGS. 17A–17I are schematic diagrams of the prefered embodiment of the system shown in FIG. 16.

Referring to the prior art loudspeaker of FIG. 1, the typical loudspeaker includes a woofer 10 for generating sonic signals generally within a low-frequency range, typically between about 20 Hz and 500 Hz; a mid-range speaker for generating sonic signals generally within a midfrequency range, typically between about 300 Hz and 3 KHz; and a tweeter for producing sonic signals within a range of about 2 KHz and 20 KHz. As shown in FIG. 2, the three different types of speakers are typically vertically mounted, one above the other on the front panel 18 of the speaker cabinet so that the prime axis or direction of radiation propagation is in front of the loudspeaker. As shown in FIG. 3A, the woofer typically produces almost an omnidirectional radiation dispersion pattern for low-frequencies, for example, between 0 and 100 Hz for a 12 inch woofer, while a less omnidirectional radiation pattern at higher frequencies of the output of the woofer, e.g., between about 200 and 500 Hz. Similarly, the mid-range and tweeter speakers provide radiation dispersion patterns as shown in FIGS. 4A and 4B, wherein FIG. 4A is the lower frequencies of each of the speakers, while FIG. 4B illustrates the dispersion pattern of the higher frequencies of the speaker. As shown, the dispersion pattern of FIG. 4A is typical of a 4 inch mid-range speaker at 2–3 KHz, while the radiation dispersion pattern of FIG. 4B is typical of such a tweeter speaker at 10–20 KHz.

When this particular type of prior art speaker is designed to provide a flat frequency response the amplitude of the power output of the speakers along the prime axis of propagation is generally flat as a function of frequency as shown in FIG. 5. However, as shown in FIG. 5, the radiation dispersed in directions other than the prime axis will not be constant as shown.

Accordingly, another approach in speaker design is to provide a flat power response into the listening area. Specifically, the speaker is designed so that the energy radiated into the listening area averaged overall direction is flat with respect to the frequency range within which the speaker radiates sound. The average power output of such a prior art system is shown in FIG. 6 as havinq a flat response. However, as shown, the power output in any one particular direction may not be flat such as the on-axis radiation curve as well as the off-axis radiation curve. Accordingly, in these conventional prior art loudspeaker systems there is a trade-off. A loudspeaker system can be designed to have a flat on-axis frequency response resulting in a power curve which is not flat as shown in FIG. 5, or a system can be designed to have a power curve which is flat resulting in an on-axis response which is not flat as shown in FIG. 6.

In accordance with the present invention, a loudspeaker system is designed to provide both a flat frequency response and a radiation dispersion pattern which can be easily predesigned without necessarily resorting to the use of unusual speaker drivers. The preferred embodiment of the present invention comprises ordinary electromagnetic loudspeakers, angularly spaced relative to one another about the verical axis of the loudspeaker cabinet and includes means for modifying as a function of frequency, the phase and amplitude of the driving signals fed to each loudspeaker driver so as to obtain a substantially flat power and on-axis frequency responses.

More particularly, as shown in FIG. 7, the preferred embodiment of the loudspeaker system includes a loudspeaker cabinet 28, including suitable baffle structure (not shown) for supporting four woofers 32A, 32B, 32C, and 32D mounted substantially in the same horizontal positions, equidistant from and at 90° intervals about the vertical axis 26 of the loudspeaker. Similarly, four mid-range speakers 34A, 34B, 34C, and 34D are mounted substantially in the same horizontal positions, preferably above the respective woofers 32, equidistant from and at 90° intervals about the vertical axis 26, as shown in FIG. 9. Finally, six tweeters 36A, 36B, 36C, 36D, 36E and 36F are mounted substantially in the same horizontal positions, preferably above the midrange speakers, equidistant from and at 60° intervals about the vertical axis 26, as best shown in FIG. 10. The front of loudspeaker 28 is defined by the positions of speakers 32A, 34A, and 36A. The front of the loudspeaker defines the direction of propagation of the prime axis of the loudspeaker. In accordance with the present invention each of the woofers 32, midrange speakers 34 and tweeters 36 each may be any type of speaker which is known in the art. Preferably, each of the speakers is of the electromagnetic type, each woofer being a conventional 10 inch speaker. By controlling the frequency and phase responses of each woofer 32, mid-range speaker 34, and tweeter 36, the desired frequency response and power dispersion pattern are achieved. Specifically, the responses of the auxillary speakers, woofers 32B–32D, mid-range speakers 34B–34D, and tweeters 36B–36F are used to complement the responses of the main speakers 32A, 34A and 36A to provide an overall flat frequency response and a preselected radiation dispersion pattern. Thus, when the main speaker drivers 32A, 34A and 36A are omnidirectional at a particular frequency, the response required from the auxiliary speaker drivers may be such as to reduce the omnidirectionality of the main driver (by radiating substantially out-of-phase) then producing the preselected radiation dispersion pattern. When more energy is radiated by the main driver at another particular frequency along the prime axis than radiated in off-axis directions, the auxiliary drivers begin to fill in for the overall dispersion characteristics. In this manner, one can tailor the amplitude and phase response of each speaker so that the system frequency response is flat in any direction, but the overall radiation dispersion pattern conforms to a preselected pattern. This is illustrated by FIGS. 11 and 12, wherein FIG. 11 shows the response of each tweeter at a relatively high frequency, while FIG. 12 shows the response of each tweeter at a relatively low frequency.

More particularly, in FIG. 11 at the higher frequencies each tweeter will generate its radiation substantially within an approximate 60° angle symmetrical about the direction of propagation of radiation from the driver, indicated by the corresponding arrow 40 so that the radiation dispersion pattern of each tweeter 36 is substantially the same as indicated by the patterns 42 to produce an overall radiation dispersion pattern 44. On the other hand, at the lower frequencies generated by the tweeters as shown in FIG. 12 the main driver 36A will generate the dispersion pattern indicated by the pattern 46A which is more omnidirectional than the pattern 42A. Thus, the adjacent drivers 36B and 36F need to contribute less, and therefore would produce patterns similar to 46B and 46F, respectively. In a similar manner, the dispersion patterns produced by the drivers 36C, 36D, and 36E produce the varied dispersion patterns 46C, 46D, and 46E which combine with the other dispersion patterns 46A, 46B, and 46F to provide the overall dispersion characteristics substantially similar to the dispersion pattern 48. Thus, by varying as a function of frequency the amplitude and phase of the driving signals provided to the tweeters, the overall radiation dispersion pattern including patterns 44 and 48 can be determined in a similar manner for all of the frequencies generated by the drivers 36. In a similar manner by controlling as a function of frequency the amplitude and phase of the driving signals to the mid-range speakers 34A–34D and the woofers 32A–32D the overall radiation dispersion patterns can be made substantially similar to patterns 44 and 48 throughout the entire frequency range of the loudspeaker, e.g., 20 Hz–20 KHz. Where it may be desirable to radiate greater power from the loudspeaker in one direction than, for example, another, the overall radiation dispersion pattern can be easily modified by varying the particular phase and power responses of each of the main and auxiliary speakers. Thus, a particular array of loudspeaker drivers (a minimum of two) can be made directional by a combination of their relative locations to one another, and by controlling as a function of frequency, the phase and amplitude of the driving signals used to drive the loudspeaker drivers.

In accordance with one aspect of the present invention, in the preferred embodiment, the specific radiation dispersion patterns of each of a pair of separate loudspeakers can be developed such that a stereophonic image can be created between the loudspeaker systems substantially independently of a listener's position within a listening area along a listening line spaced from the loudspeaker systems and non-intersecting with a line extending between the loudspeaker systems. This will be more evident by the following description with respect to FIGS. 13 and 14.

Referring to FIG. 13, conventional prior art loudspeakers 10 can, for example, produce constant average power outputs. If the power output of each speaker 10 is approximately the same then a listener positioned approximately equidistant from each speaker 10 along a listening line $L_2$, parallel to a line $L_1$ extending between the two loudspeakers, the listener will perceive an apparent stereophonic image (the apparent location of the source of the sound as heard by the listener) approximately in the center between the two speakers, as indicated by the point I. With the conventional prior art system shown in FIG. 13, the listener receives information from the speakers which includes amplitude and phase. Various certain phase delays occur between the left and right speakers. A small interaural phase delay occurs as one moves closer to one speaker than the other. Thus, should the listener move along the listening line $L_2$ in a direction toward either one of the loudspeakers 10, the stereophonic image will no longer be perceived and at some point all of the sound will appear to come from one speaker 10 only.

In accordance with the present invention, two speakers 28A and 28B are designed to each produce radiation dispersion characteristics such that the stereo image I will appear to be in the same location regardless of the listener's position along the listening line $L_2$, as well as substantially any other position in the listening space except those positions between the two loudspeakers, although best results ae achieved if the listener is positioned at a distance greater than one-fourth the distance between the two speakers 28A and 28B. In this regard, therefore, the listening line $L_2$ can be defined as any line spaced from the loudspeakers 28A and 28B so long as it does not intersect the line $L_1$ between the two loudspeakers. In order to achieve this, it has been determined that in addition to having a flat frequency response in substantially all directions, each speaker should have a radiation dispersion pattern in which a greater power output will be provided along the prime axis of the speaker at each frequency than in other directions, so that the radiation dispersion pattern at each frequency will be substantially oval as shown in FIG. 14.

In particular, two loudspeakers 28A and 28B are preferably oriented so that the prime axes of radiation propagation 50A and 50B (the prime direction of radiation propagation of each of the main speaker drivers 32A, 34A and 36A of each loudspeaker) of each loudspeaker is directed toward the opposite speaker so that the prime axes are aligned with one another, and define the line $L_1$. If both speakers receive the same amount of power, the stereo image I will be created in the center between the two speakers. However, because of the predesigned radiation dispersion pattern of each speaker, as the listener moves along the listening line $L_2$, the sound intensity from the nearer loudspeaker is reduced, while that from the further loudspeaker is increased, thus, the stereo image will still appear to be generated from the same point I between the two speakers.

In order to provide the radiation dispersion pattern similar to the type shown in FIG. 14, the preferred cross-over network utilized with each of the speakers is shown in FIGS. 15A–15C. This preferred network is further designed to provide a substantially flat input impedance as a function of frequency so that any audio amplifier (not shown) of sufficient power can be utilized. More particularly, referring to FIG. 15B, the input signal from any power amplifier of sufficient power is provided to the two input terminals 100 and 102. Terminal 102 is connected to system ground, while terminal 100 is connected to the woofer network section shown in FIG. 15A, the mid-range network section shown in FIG. 15B, and the tweeter network section shown in FIG. 15C. More particularly, the terminal 100 is connected in FIG. 15A to the inductor 104, which in turn is connected through capacitor 106 to system ground. Inductor 104 is also connected through each of the inductor 108, resistor 110, and capacitor 112 to the speaker connection 114. The latter in turn is connected to the main woofer driver 32A, driver 32A being suitably grounded. Inductor 104 is also connected through resistor 116 to one plate of capacitor 118. The other plate of capacitor 118 is in turn connected to the speaker connection 120. Inductor 104 also is connected to resistor 122, which in turn is connected to inductor 124. The latter is connected to connector 120. Inductor 104 is also connected through each of the inductor 126 and capacitor 128 to inductor 124. The speaker connection 120 is in turn connected to both of the side woofer drivers 32B and 32D, the drivers being suitably grounded as shown. Finally, the inductor 104 is connected to each of the resistors 130 and 132. Resistor 130 in turn is connected to one plate of the capacitor 132, the latter having its other plate connected to the speaker connection 134 and inductor 136. Inductor 136 is in turn connected to system ground. Resistor 138 in turn is connected through inductor 140 to the speaker connection 142 and to one of the plates of capacitor 144, the latter having its other plate connected to a system ground. The speaker connections 134 and 142 are connected to the two input terminals of the rear woofer speaker driver 32C.

Referring to FIG. 15B, terminal 100 is connected to the input inductor 150, which in turn is connected to one plate of capacitor 152. The other plate of capacitor 152 is connected to system ground. Inductor 150 also is connected to one plate of capacitor 154, the other plate being connected to the remainder of the mid-range network section. Specifically, capacitor 154 is connected through conductor 156 to system ground and directly to the speaker connection 158. Connection 158 is in turn connected to the main mid-range speaker driver 34A, the latter being suitably grounded. Capacitor 154 is also connected to the resistors 157 and 162. Resistor 157 is in turn connected through capacitor 159 to the speaker connection 160. Resistor 162 is connected through inductor 164 to the connection 160. Connection 160, in turn, is connected to each of the side mid-range speaker drivers 34B and 34D, the drivers each being suitably grounded. Capacitor 154 is also connected in a similar manner to each of the resistors 166 and 172. Resistor 166 is connected through capacitor 168 to the speaker connection 170. Resistor 172 is connected through inductor 174 to connection 170. Connection 170, in turn, is connected to the rear mid-range speaker driver 34C which in turn is suitably grounded, as shown.

Referring to FIG. 15C, the terminal 100 is connected to one plate of capacitor 180 of the tweeter network section. The other plate of capacitor 180 is connected to the remaining network section for the tweeter drivers 36A through 36F. More particularly, capacitor 180 is connected through inductor 182 to system ground. Capacitor 180 is also connected to the speaker connection 184 which, in turn, is connected to the front tweeter speaker driver 36A, the latter being suitably grounded, as shown. Capacitor 180 is also connected to two resistors 186 and 192. Resistor 186 is connected through capacitor 188 to the speaker connection 190. Resistor 192 is connected through inductor 194 to the connection 190. Connection 190 is connected to each of the tweeter speaker drivers 36B and 36F, the latter drivers being angled 60° to either side of the driver 36A. Drivers 36B and 36F are suitably grounded as shown. Capacitor 180 is also connected to resistors 196 and 202. Resistor 196 is connected through capacitor 198 to the speaker connection 200. Resistor 202 is connected through inductor 204 to connection 200. The latter, in turn, is connected to each of the tweeter speaker drivers 36C and 36E, each of the drivers being displaced 120° to either side of the main driver 36A and suitably grounded, as shown. Capacitor 180 is also connected through resistor 206 to the capacitor 208, which in turn is connected to the speaker connection 210. Capacitor 180 is also connected through inductor 212 to connection 210. Speaker connection 210 is connected to the rear tweeter speaker driver 36D displaced 180° from the main speaker driver 36A and suitably grounded as shown. Preferably, the components of the cross-over network sections shown in FIGS. 15A–15C have the following values shown in TABLE A, although it will be appreciated that these values may vary depending upon the specific speaker drivers used and the type of radiation dispersion pattern desired. In TABLE A each inductor is indicated with the prefix L, each resistor is indicated with the prefix R and each capacitor is indicated with the prefix C. The inductors are given in values of henries, with MH indicating millihenries, the resistors are given in values of ohms, and the capacitors are given in values of farads, with uf indicating microfarads.

TABLE A

| Element | Value |
|---|---|
| WOOFER NETWORK SECTION | |
| L104 | 2MH |
| C106 | 100uf |
| L108 | 39MH |

TABLE A-continued

| Element | Value |
|---|---|
| R110 | 91 |
| C112 | 330uf |
| R116 | 10 |
| C118 | 330uf |
| R122 | 5.1 |
| L124 | 5.3MH |
| L126 | 23.2MH |
| C128 | 330uf |
| R130 | 10 |
| C132 | 330uf |
| L136 | 11MH |
| R138 | 5.1 |
| L140 | 5.3MH |
| C144 | 22uf |
| MIDRANGE NETWORK SECTION | |
| L150 | 0.350MH |
| C152 | 10uf |
| C154 | 47uf |
| L156 | 2MH |
| R157 | 7.5 |
| C159 | 10uf |
| R162 | 7.5 |
| L164 | 3.4MH |
| R166 | 22 |
| C168 | 10uf |
| R172 | 18 |
| L174 | 3.4MH |
| TWEETER NETWORK SECTION | |
| C180 | 10uf |
| L182 | 0.600MH |
| R186 | 2.2 |
| C188 | 1.5uf |
| R192 | 6.0 |
| L194 | 0.237MH |
| R196 | 22 |
| C198 | 0.47uf |
| R202 | 10 |
| L204 | 0.237MH |
| R206 | 13 |
| C208 | 0.68uf |
| L212 | 0.680MH |

The cross-over network shown in FIGS. 15A, 15B and 15C thus control the amplitude and phase, as a function of frequency of each of the driving signals applied to the speaker drivers. As shown in FIG. 15A, the main woofer speaker 32A will receive most of the bass signal which passes through the woofer network section and thus functions as the main speaker driver. On the other hand, the rear woofer speaker 32C is driven by a driving signal which is largely out of phase with the speaker driver 32A. The portion of the network including resistors 130 and 138, capacitors 132 and 144, and inductors 136 and 140 for driving the rear woofer speaker driver functions as an all-pass network. At low frequencies the capacitors will function essentially as open circuits and the signal is transmitted across the driver in one direction. However, at high bass frequencies, the capacitors will function essentially as short circuits and the driving signal transmitted to the speaker driver 32C is in the opposite direction or 180° out-of-phase. The mid-frequency portion of the bass signal will be applied to speaker driver 32C in a combination of both. It therefore should be appreciated that by controlling the amplitude and phase of the driving signal, as a function of frequency, for each of the speaker drivers the cross-over network will essentially shape the radiation dispersion pattern for the woofers 32A–32D, for the mid-range speakers 34A–34D, and for the tweeters 34A–34F. With the particular values set forth in TABLE A the sterephonic image I of FIG. 14, created between the two loudspeakers 28A and 28B will be substantially independent of the listener position along the listening line $L_2$. Adjust the amplitude relative to the listener location so that the apparent location remains unchanged. Thus, due to the contoured radiation dispersion pattern provided, as the listener moves closer to one loudspeaker 28 the volume drops with respect to the closer speaker, while it increases with respect to the more distant speaker.

The preferred loudspeaker system of the present invention includes other novel aspects including means for sensing the power applied to each loudspeaker 28 and for by-passing a signal processing system for processing the audio signal applied to the loudspeaker when the power drops below a predetermined minimum level. Other novel aspects include means for preventing the loudspeaker drivers from being overdriven, and means for substantially balancing the long term signal energy levels between two stereophonic channels. The preferred embodiment, including the above-recited means, is incorporated in the signal processing system shown in FIG. 16. For obtaining the preferred embodiment of the present invention, the system shown in FIG. 16 is adapted to be utilized with the cross-over network described and shown in FIGS. 15A–15C together with two of the speakers 28A and 28B. The system shown in FIG. 16 is preferably contained in a separate unit from the cross-over network and speakers.

For convenience, all components which are duplicated for each channel are shown in the drawings with a suffix A for one audio channel and the suffix B for the other audio channel. For convenience and ease of exposition however, some of the components shown will be described generally without the suffix A or B where the context makes it preferable, it being understood that the description applies for both channels.

Referring specifically to FIG. 16, the system shown is adapted to receive the right and left channel signal inputs at 250A and 250B typically from the output of a preamplifier of a receiver, tape system or a turntable (none being shown). These inputs 250A and 250B are the inputs to the main signal paths of the system. Signal inputs 252A and 252B are provided to the control signal paths of the system and receive the power signals present at the inputs of the each of the loudspeakers 28A and 28B, respectively. The right channel input 250A and left channel input 250B are respectively coupled to input buffers 254A and 254B. The output of the buffers are respectively connected to low pass filters 256A and 256B and over the corresponding by-pass signal paths 257A and 257B to the respective output and auto by-pass switch circuits 276A and 276B, the latter being described hereinafter. The low pass filters 256A and 256B are respectively connected to the two input terminals of the auto-balance circuit 258 and to the respective inputs of equalizer circuits 260A and 260B. The auto-balance circuit 258 is adapted to measure the power level of the signals transmitted in each of the channels, and to determine the relative power levels of the two and provide output signals as a function of the power levels measured. These two output signals are in turn applied to the control input terminals of the gain control circuits 270A and 270B (described hereinafter) respectively, for impressing a signal gain on the signal transmitted in each channel so that the long term signal energy levels in the two channels will remain substantially balanced.

As described in copending U.S. patent application Ser. No. 500,942 filed simulataneously herewith by Leslie B. Tyler and assigned to the present assignee, (herewith referred to as the "Copending application") the outputs of equalizer circuits 260A and 260B are connected to input matrix 262, the latter being adapted to receive the right and left channel inputs and provide an L+R output and an L−R output. As is well-known, the L+R output will contain the horizontal components of vinyl record modulation of the stereophonic signal, typically in the low frequency range of the audio signal, while the L−R signal will contain the vertical components such as ambience information. The L+R output is connected to the low frequency equalization control circuit 264, while the L−R output is connected to the ambience control circuit 266. The low frequency equalization control 264 is adapted to boost low frequency energy transmitted at the output of the L+R output of the input matrix 262. Since the signal input to the low frequency equalization circuit 264 is the L+R component it will not contain any out-of-phase vertical components of the audio signal, such as turntable rumble, since the latter are cancelled when the two signals L and R are added together by the matrix 262. The control 264 therefore will not boost these vertical noise components. The ambience control circuit 266 is adapted adapted to provide more meaningful ambient information. In particular, the mid frequency information, approximately that information between 400 Hz and 2.6 KHz is extracted by filtering. It is within this frequency range that more meaningful ambient information is contained. The ambience control circuit 266 is also adapted to include a potentiometer 267 to allow the listener to adjust the ambient information processed. The respective outputs of control circuits 264 and 266 are applied to the output matrix 268.

Matrix 268 is adapted to provide the left channel signal L, as modified by the control circuits 264 and 266, to the input of the gain control circuit 270A. In a similar manner, matrix 268 provides the right channel signal R, as modified by the control circuits 264 and 266, to the input of the gain control circuit 270B.

Gain control circuits 270A and 270B are adapted to vary the gain impressed on the respective input signals R and L in response to and in accordance with either one or both of two control signals, one provided from the auto-balance circuit 258, and the other provided from the control signal paths, described hereinafter. Gain control circuits can be any type of circuit for controlling signal gain in response to one or more control signals, and preferably is a signal multiplier, such as the voltage control amplifier of the type described in U.S. Pat. No. 3,714,462, issued to David E. Blackmer on Jan. 30, 1973. Preferably, the gain control circuits are set to provide gain in a signal compression sense so that the amount that the output signal of each channel is reduced is a function of the control signals applied to the control input terminals from the auto-balance circuit 258 and the power monitor circuit 280, the latter being described hereinafter. The output of the gain control circuits 270A and 270B are connected to the respective inputs of the high frequency tone control circuits 272A and 272B. The latter, in turn, have their outputs connected to the corresponding high pass filters 274A and 274B. The high pass filters have their outputs connected to the respective inputs of the output and auto by-pass switch circuits 276A and 276B. Circuits 276A and 276B are adapted to provide the two outputs 278A and 278B as the right and left channel outputs, which are adapted to be connected to a stereophonic preamplifier. Circuits 276A and 276B are also adapted switch between (1) the bypass signal path 257A and 257B when the power sensed at both of the inputs 252A and 252B of the control signal paths drops below a minimum level as described in greater detail hereinafter, and (2) the signal path defined by the components 256–276 when the power sensed at inputs 252A and 252B is above the minimum level.

The inputs 252A and 252B are connected to the respective inputs of the balanced to single-ended converters 279A and 279B for transmitting single ended signals (i.e. signals having a reference to system ground) and for converting any differential signals (e.g., a positive signal with respect to ground is applied to the positive terminal of an input 252, and a negative signal with respect to ground is applied to the negative terminal of that input) to single ended signals. The outputs of the converters 279A and 279B are connected to the inputs of each of the power monitor 280 and the auto by-pass circuit 282. Monitor 280 is provided for preventing the loudspeaker drivers from being overdriven while auto by-pass circuit 282 is provided for sensing the power applied to the loudspeakers 28A and 28B, and for controlling the signal paths of signals applied to inputs 250A and 250B.

More particularly, the outputs of converters 279A and 279B are each connected to the respective frequency weighting filters 284A and 284B of the power monitor 280. Filters 284A and 284B are adapted to transmit the medium and high frequency portions of the signals received from the converters 279A and 279B for reasons which will be more evident hereinafter. The output of each of the filters 284A and 284B are connected to the respective signal level detectors 286A and 286B. The latter are each adapted to provide a control signal output, typically a DC signal, as a function of the amplitude level of the signal at its input. The output, for example, can be a function of the instantaneous peak amplitude levels of the input signal, the average amplitude levels of the input signal or preferably the RMS level of the input signal. Such RMS level detectors are well-known in the art, such as the RMS level detector shown and described in U.S. Pat. No. 3,681,618, issued to David E. Blackmer on Aug. 1, 1972. The two DC outputs of detectors 286A and 286B are compared by the greater of the two circuit 288, the latter providing an output signal as a function of the greater of the two input signals from detectors 286A and 286B. The output signal of circuit 288 is provided to the power threshhold detector 290 which compares the output of circuit 288 with a predetermined reference level. The latter reference level is a function of the maximum power input to the speaker drivers, and preferably the mid-range drivers and tweeters, above which the speaker drivers will be overdriven or otherwise damaged. The output of detector 290 accordingly is connected to a control input of each of the gain control circuits 270A and 270B.

The outputs of the converters 279A and 279B are also respectively connected to the inputs of the auto by-pass circuit 282. The latter includes gain stages 294A and 294B for amplifying the outputs of converters 279A and 279B. The outputs of gain stages 294A and 294B are applied to the respective inputs of bandpass filters 296A and 296B, respectively. The latter are adapted to pass signal energy between about 20 Hz and 8 KHz. The output of filters 296A and 296B are respectively connected to level detectors 298A and 298B. The latter also can be peak, average, or RMS detectors and are preferably of the averaging type for averaging the signals for relatively long periods of time. The output of each detector 298 therefore provides a DC signal as a function of the long-term average of the power level in each of the channels between about 20 Hz and 8 KHz. The output of each detector 298 is applied to the comparators 300A and 300B, respectively. The latter compare the output of each detector 298 with a reference signal and provide an output so long as the signal level output of each detector is above the predetermined level, and is adapted to provide a zero output when this level drops below the predetermined set level. The output of each comparator is thus applied to the input of a switch driver 302, the latter being adapted to provide an output to each of the auto by-pass switches of circuits 276A and 276B.

In operation, the system shown in FIG. 16 substantially balances the signal energy level between the two audio channels over a long period of time. This is achieved by the utilization of the auto-balance circuit 258 which compares the two power levels in each of the channels provided from the filters 256A and 258B. The auto-balance circuit 260 provides two control signals to the respective gain control circuits 270A and 270B so as to vary the gain impressed on each of the signals in the channels so that the signal levels at the outputs 278A and 278B are substantially the same over long periods of time. Since the gain control circuits are set for both negative and positive gain, the channel transmitting greater signal energy over a relatively long period of time will be reduced in gain and the other channel will be increased in gain so that the total signal energy level in both channels will be substantially the same.

The system shown in FIG. 16 also prevents the loudspeakers from being overdriven. This is accomplished by monitor 280. More particularly, the two power inputs provided at 252A and 252B are transmitted and/or converted by converters 279A and 279B. The output signals of converters 279A and 279B are filtered by the frequency weighting filters 284A and 284B. The latter essentially transmit the signal energy in the middle and high frequency ranges which are applied to the midrange and tweeter speaker drivers since the midrange and tweeter drivers are more sensitive to excess power than the corresponding woofer speakers. The output of filters 284A and 284B are applied to the RMS level detectors 286A and 286B which provide DC output signals as a function of the RMS value of the respective input signals to the detectors. The DC control output signal of each detector is compared with one another by the greater of the two circuit 288, the latter providing an output signal as a function of the greater of the two signals. This larger signal is compared with the reference level determined by the power threshhold detector and should the power exceed a preset predetermined level a DC output signal is provided to the control inputs of each of the gain control circuits 270A and 270B. As well known in the art, the gain control circuits vary the signal gain impressed on the signals transmitted over each of the main signal paths of each channel in response to and as a function of the amplitude of the DC control signal output of the power threshold detector 290. Generally, the greater the level of the DC control signal output the greater the reduction in gain impressed on the main signals by the gain control circuits. Thus, in this way, gain control circuits 270A and 270B function as signal compressors.

In addition, the system senses the power applied to the audio signals applied to inputs 250 to be transmitted over the signal paths defined by the components 256–276 when the power sensed at inputs 252 is at least at a predetermined minimum level. The system also allows any signals applied to inputs 250A and 250B to be transmitted over the signal paths 257, preventing the audio signals from being modified by equalizers 260A and 260B, when, for example, it is desirable to listen to the program on earphones. The foregoing is achieved by virtue of the auto by-pass circuit 282. More particularly, the latter senses the right and left power signals applied to the loudspeakers at inputs 252A and 252B. Each of these signals are transmitted and/or converted by the converters 279A and 279B, and subsequently amplified by the gain stages 294A and 294B. The amplified signals are filtered by the bandpass filters 296A and 296B and applied to the level detectors 298A and 298B. Since detectors provide an output of the average power level applied to its input over a long period of time, fast changing signals will not substantially affect the output of the detectors 298A and 298B. So long as the output signals of detectors 298 are above the reference levels set by comparators 300A and 300B, the latter will provide outputs to the switch driver 302, which in turn provides signals to the auto by-pass switches of circuits 276A and 276B so that the latter remain conductive to transmit the signals through the system components 256–276 to the right and left channel outputs 278A and 278B.

However, should the power level drop below a minimum level as determined by comparators 300A and 300B, the output of level detectors 298A and 298B will fall below the reference levels set for each of the comparators 300A and 300B so that the switch driver 302 no longer provides an output signal to the auto by-pass switches of circuits 276A and 276B. This in turn results in the circuits 276A and 276B to become nonconductive and therefore no output is provided to the right and left channel outputs 278A and 278B. This has the advantage of preventing microphone action in the speakers when the speakers are not in use.

The preferred embodiment of the system illustrated in FIG. 16 is shown in schematic form in FIGS. 17A–17I.

Figure 17A:
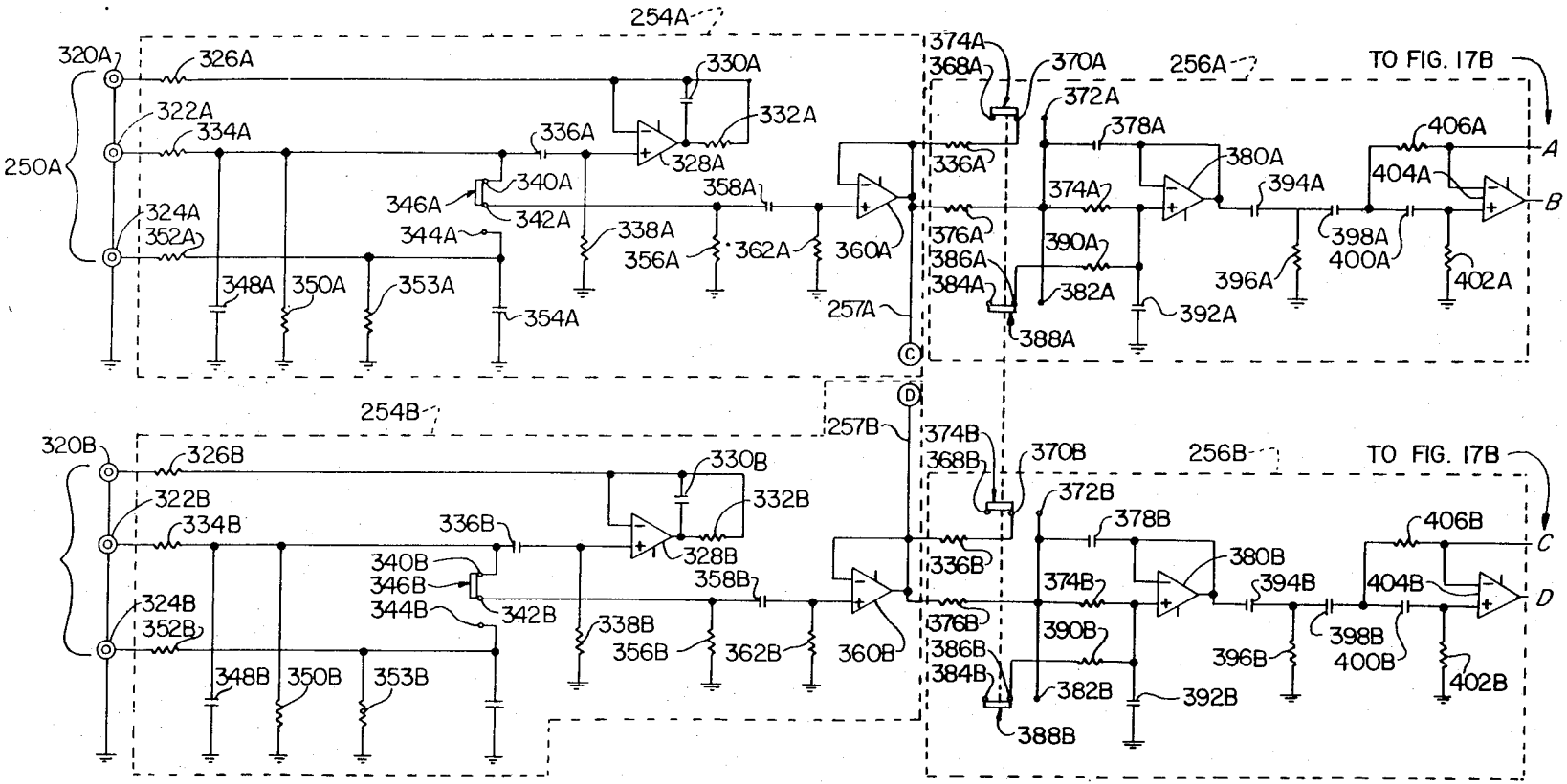

More particularly, referring to FIG. 17A, since the system is adapted to be connected to receive any input from a tape recorder, turntable or receiver preamplifier, each input 250A and 250B of the input buffers includes three plug receptacles 320, 322, and 324 connected together and to system ground, for connecting the system to any type of source of an audio program. Plug receptacle 320 is connected through resistor 326 to the inverting input of operational amplifier 328. The latter has its output connected through feedback capacitor 330 and through feedback resistor 332 to its inverting input. The plug receptacle 322 is connected through resistor 334 to the capacitor 336. The latter in turn is connected to the noninverting input of operational amplifier 328 and through resistor 338 to system ground. The junction formed by resistor 334 and capacitor 336 is connected to one contact 340 of the switch 346. The latter has second and third contacts 342 and 344 and is movable between a first position wherein contacts 340 and 342 are connected together and a second position wherein contacts 342 and 344 are connected together, depending upon the source of the audio program. The junction formed by resistor 334 and capacitor 336 is connected through capacitor 348 to system ground and through resistor 350 to system ground.

The plug receptacle 324 is also connected through resistor 352 to the contact 344 of switch 346. The resitor 352 is also connected through each of resistor 353 and capacitor 354 to system ground. The contact 342 of switch 346 is connected through resistor 356 to system ground and through capacitor 358 to the noninverting input of amplifier 360. The latter input is also connected through resistor 362 to system ground. Amplifier 360 has its output connected to its inverting input. The output of amplifier 360 forms the output of input buffer 254 and is connected to the port C (in the case of buffer 254A) and port D (in the case of buffer 254B) so that the signal can be transmitted along a bypass signal path 257 to the corresponding ports of the output circuits 276A and 276B, bypassing the system path shown. The output of input buffer 254 is connected to the input of low pass filter 256.

Specifically, the output of amplifier 360 is connected through resistor 366 to the contact 370 of a switch 374, and through resistor 376 to the contact 372 of the switch 374. Contact 368 of switch 374 is not connected, while the contact 372 of the switch is connected through capacitor 378 to the inverting input of amplifier 380. Contact 372 is also connected to the contact 382 of a switch 388. Switch 388 has contact 384 unconnected and contact 386 connected through resistor 390 to capacitor 392, which in turn is connected to system ground. Resistor 390 is also connected to the noninverting input of amplifier 380. Switches 376 and 388 are ganged together so that in one position of the switch 374 and 388 the contacts 370 and 372 of switch 374 and the contacts 382 and 384 of switch 388 are connected disconnecting resistors 366 and 390 from the circuit shown, and in a second position the contacts 370 and 372 of switch 374 and contacts 382 and 386 of switch 388 are connected together so as to connect resistors 366 and 390 into the circuit.

The output of amplifier 380 of filter 256 is connected through capacitor 394, which in turn is connected to system ground through resistor 396. Capacitor 394 is also connected through capacitor 398 to resistor 406, which in turn is connected to the inverting input of amplifier 404. Capacitor 398 is also connected to capacitor 400. Capacitor 400 is in turn connected through resistor 402 to system ground and to the noninverting input of amplifier 404. Amplifier 404 has its output connected directly to its inverting input. The output of amplifier 404 forms the output of filter 256 which is connected to the input of the auto-balance circuit circuit 258, shown in detail in FIG. 17C.

Figure 17B:
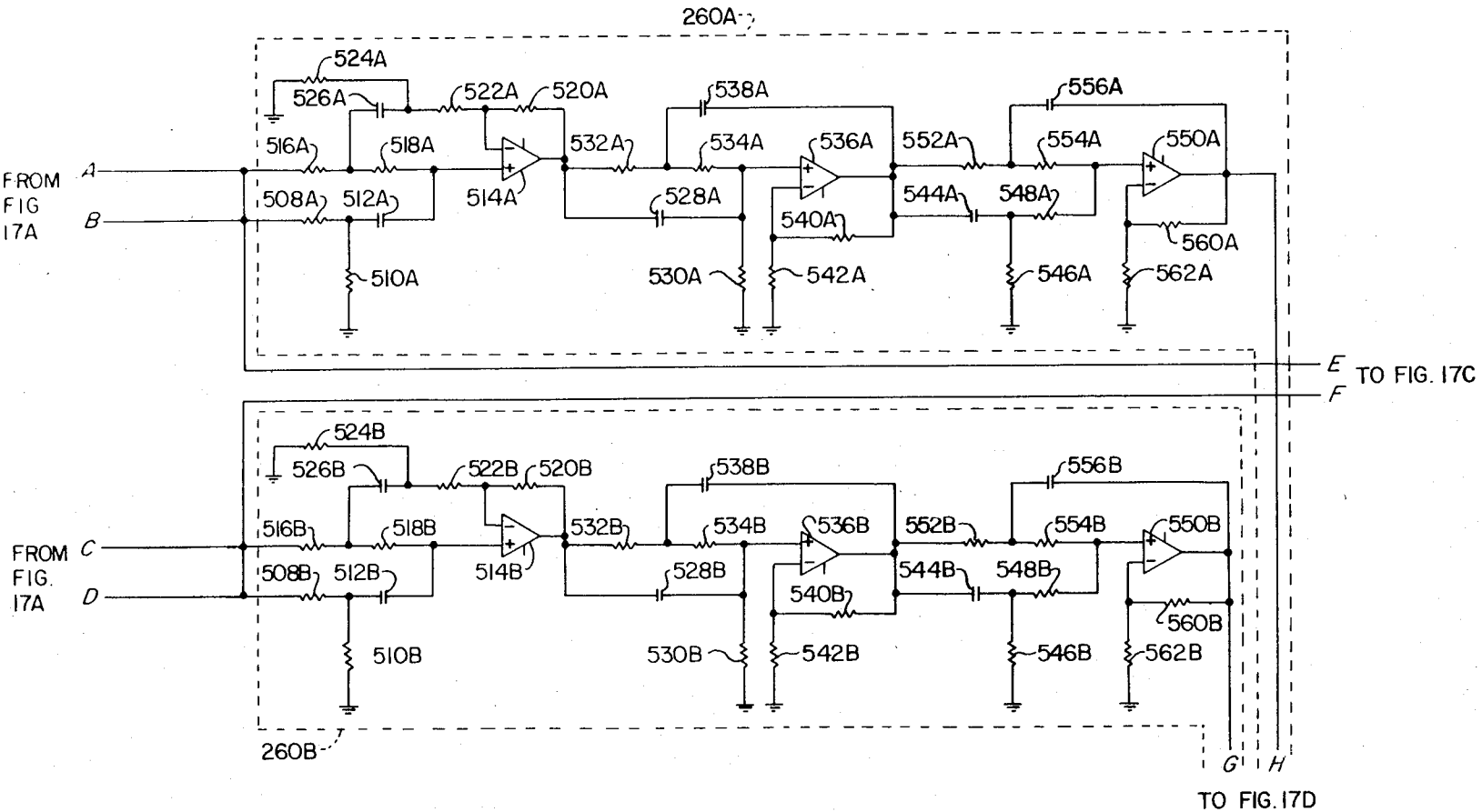
Figure 17C:
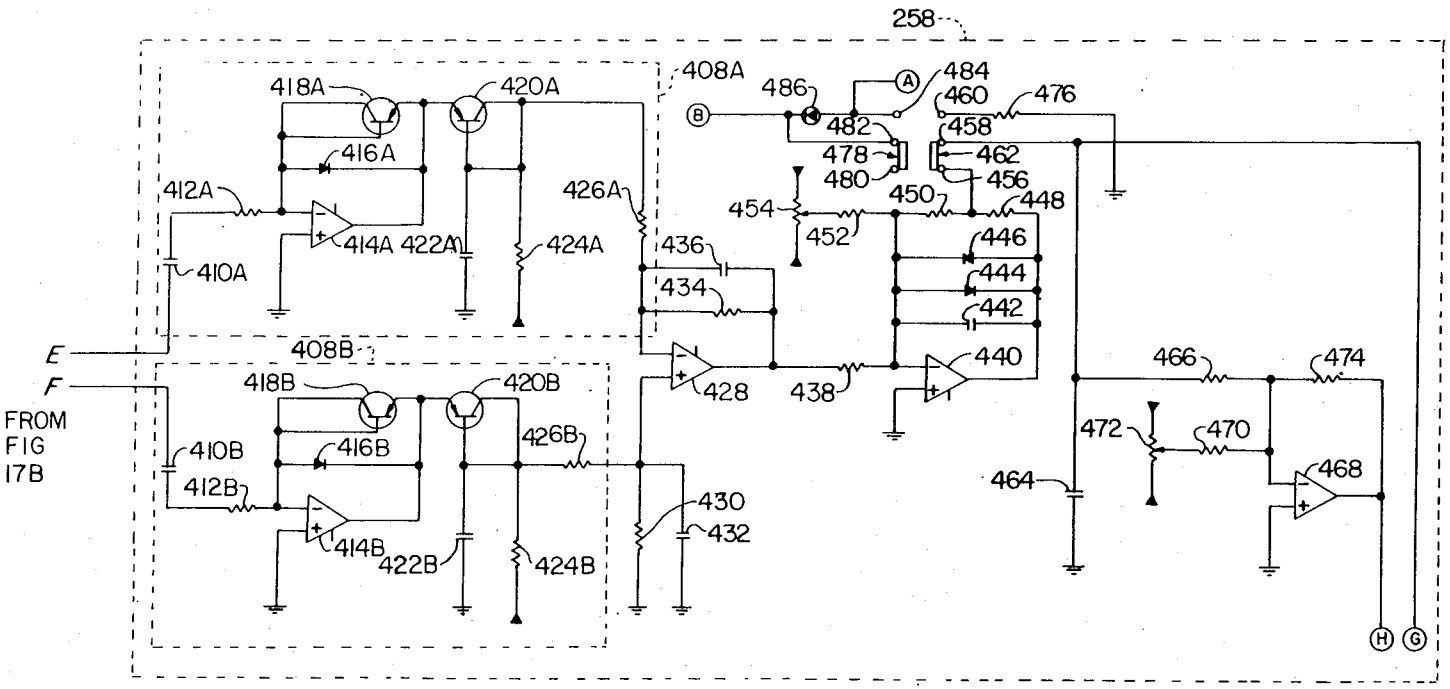

More particularly, referring to FIG. 17C, the output of amplifier 404 of low pass filter 256 is connected to the input of an average signal detector 408 of the circuit 258. More specifically, the input to the detector includes capacitor 410 which is connected to the resistor 412. Resistor 412 in turn is connected to the inverting input of amplifier 414, the latter having its noninverting input connected to system ground. The output of amplifier 414 is connected to the cathode of a diode 416, which in turn has its anode connected to the inverting of amplifier 414. The output of amplifier 414 is also connected to the emitter of transistor 418, which in turn has its collector and base connected together and to the inverting input of amplifier 414. The output of amplifier 414 is also connected to the emitter of transistor 420, which in turn has its base and collector connected together through capacitor 422 to system ground. The base and collector of transistor 420 are also connected through resistor 424 to system ground. The base and collector of transistor 420 are also connected through resistor 426 to the output of the detector. The resistors 426A and 426B of both channels are connected respectively to the inverting and noninverting inputs of amplifier 428. The noninverting input of amplifier 428 is connected through resistor 430 and through capacitor 432 to system ground. The output of amplifier 428 is connected through each of the feedback resistor 434 and feedback capacitor 436 to its inverting input. The output of amplifier 428 is also connected through resistor 438 to the inverting input of a amplifier 440. The latter has its noninverting input connected to system ground and its output connected through feedback capacitor 442 to its inverting input. The output of amplifier 440 is also connected to the cathode of a diode 444 and the anode of a diode 446. The anode of diode 444 and the cathode of diode 446 are each connected to the inverting input of amplifier 440. The output of the amplifier 440 is also connected to resistor 448, which in turn is connected to resistor 450. Resistor 450 in turn is connected to the inverting input of amplifier 440 and to the resistor 452. Resistor 452 in turn is connected to the wiper arm of potentiometer 454. The junction between resistors 448 and 450 is connected to the contact 456 of the switch 462. The contact 458 of switch 462 is connected through capacitor 464 to system ground and through resistor 466 to the inverting input of amplifier 468. The inverting input of amplifier 468 is connected through resistor 470 to the wiper arm of potentiometer 472. The noninverting input of amplifier 468 is connected to system ground while its output is connected through resistor 474 to its inverting input. The output of amplifier 468 is connected to the port H, which in turn is connected to control input 788A of the gain control circuit 270A in the right channel signal path, as shown in FIG. 17E and described hereinafter. The contact 458 of switch 462 is also connected directly to port G, which in turn is connected to the control input terminal 788B of the gain control circuit 270B in the left channel signal path, also shown in FIG. 17E and described hereinafter. The contact 460 of switch 462 is connected through resistor 476 to system ground.

A second switch 478 has one contact 480 disconnected and its second contact 482 connected to port B, which in turn is connected through a light-emitting diode (not shown) to system ground. The third contact 484 is connected directly to port A, the latter being connected to the low frequency equalizer control circuit 264, (shown in FIGS. 17D and 17E and described in greater detail hereinafter) and to the anode of a light-emitting diode 486. The latter has its cathode connected to port B, which in turn is connected through a light-emitting diode (not shown) to system ground.

Switches 462 and 478 are ganged together so that in one position the contacts 456 and 458 of switch 462 and contacts 480 and 482 of switch 478 are closed and the auto-balanced circuit is connected into the circuit and in a second position the contacts 458 and 460 of switch 462 and contacts 482 and 484 of switch 478 are closed and the auto-balanced circuit is disconnected from the system.

Figure 17D:
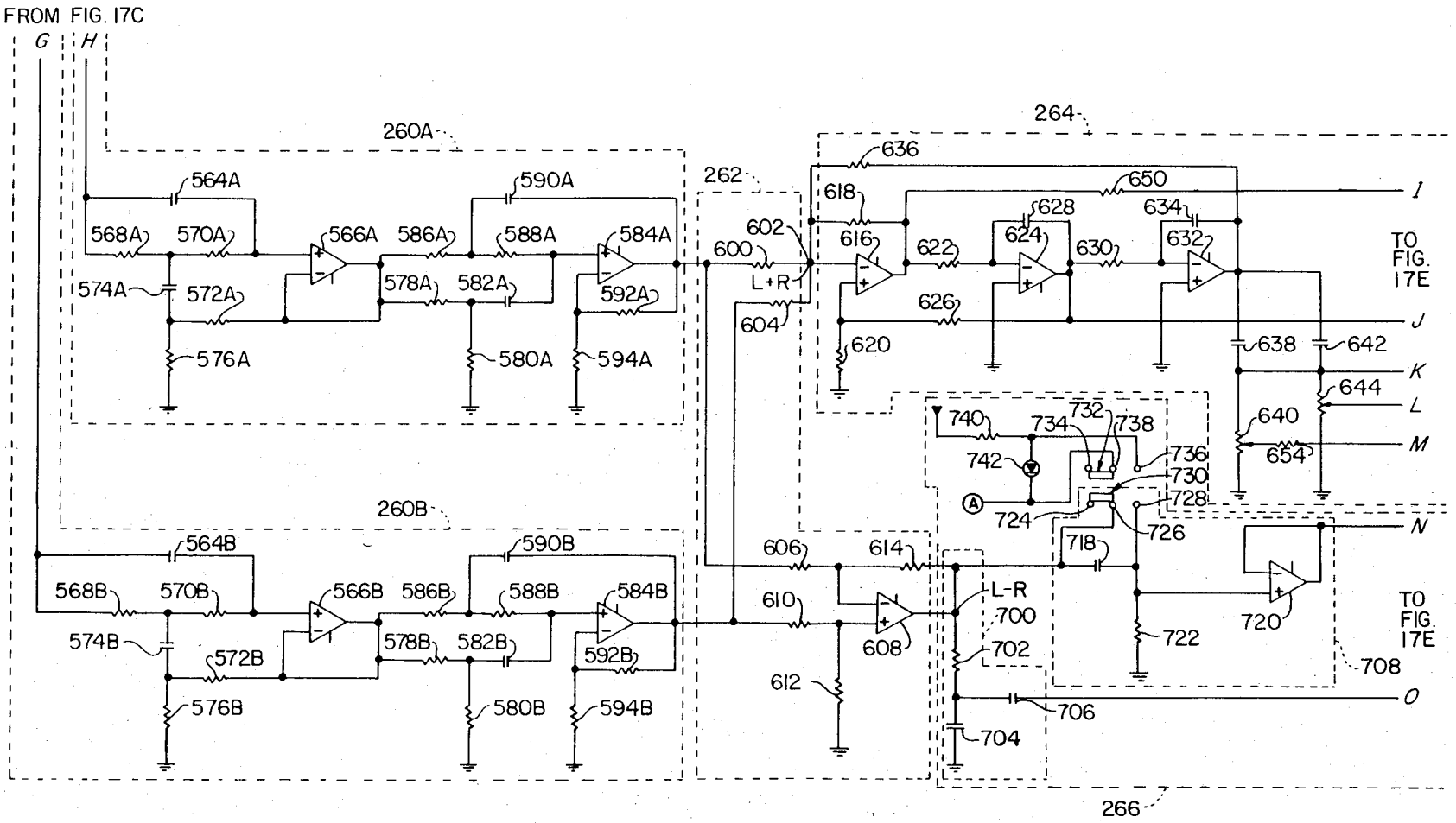
Figure 17E:
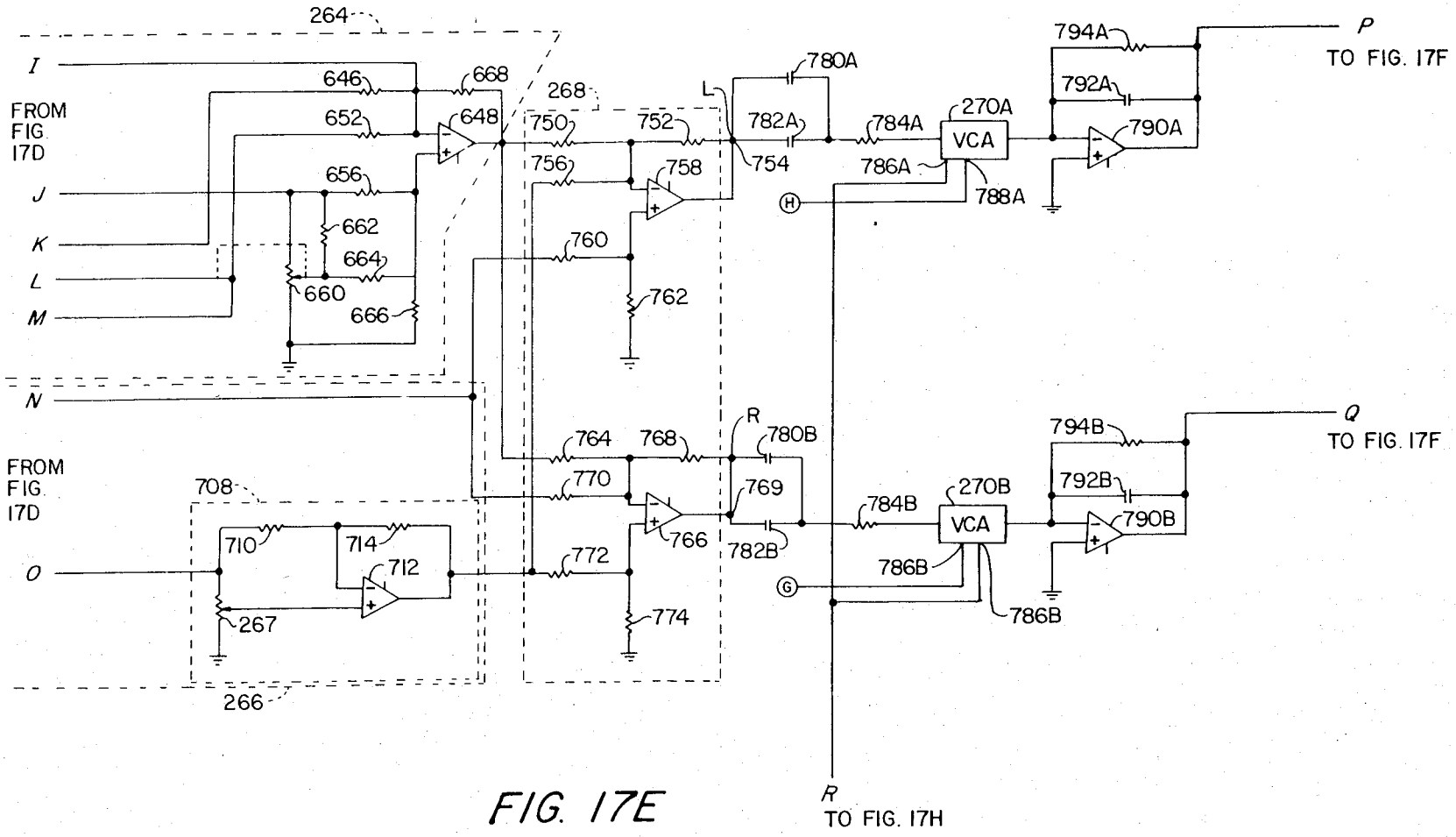

The output of each filter 256 is also connected to the input of the corresponding equalizer circuit 260, as shown in FIGS. 17B and 17D. More particularly, the output of amplifier 404 of the filter 256 is connected through resistor 508 to resistor 510, which in turn is connected to system ground. Resistor 508 is also connected through capacitor 512 to the noninverting input of amplifier 514. The input of the equalizer circuit is also connected through resistor 516 to resistor 518. The latter, in turn, is connected also to the noninverting input of amplifier 514. The output of amplifier 514 is connected through feedback resistor 520 to its inverting input and to resistor 522. Resistor 522 in turn is connected through resistor 524 to system ground. The junction of resistors 522 and 524 is connected through capacitor 526 to the junction formed by resistors 516 and 518. The output of amplifier 514 is connected through capacitor 528 to resistor 530, which in turn is connected to system ground. The output of amplifier 514 is also connected to resistor 532, which in turn is connected through resistor 534 to the junction of capacitor 528 and resistor 530, and to the noninverting input of amplifier 536. The output of the latter is connected through feedback capacitor 538 to the junction formed by resistors 532 and 534. The output of amplifier 536 is also connected through feedback resistor 540 to the inverting input of amplifier 536, the inverting input being connected through resistor 542 to system ground. The output of amplifier 536 is connected through capacitor 544 to resistor 546, which in turn is connected to system ground. The junction of capacitor 544 and resistor 546 is connected through resistor 548 to the noninverting input of amplifier 550. The output of amplifier 536 is also connected through resistor 552 to resistor 554 which in turn is connected to the noninverting input of amplifier 550. The output of amplifier 550 is connected through capacitor 556 to the junction formed by resistors 552 and 554. The output of amplifier 550 is also connected through feedback resistor 560 to its inverting input and to the resistor 562. The latter is in turn connected to system ground.

Referring to FIG. 17D, the output of amplifier 550 is connected to capacitor 564, which in turn is connected to the noninverting input of amplifier 566. The output of amplifier 550 is also connected through resistor 568 to resistor 570, which in turn is connected to the noninverting input of amplifier 566. The output of amplifier 566 is connected directly to its inverting input and to resistor 572. Resistor 572 is in turn connected through capacitor 574 to the junction formed by resistors 568 and 570 and through resistor 576 to system ground. The output of amplifier 566 is also connected to resistor 578 to the resistor 580, which in turn is connected to system ground. Resistor 578 is also connected through capacitor 582 to the noninverting input of amplifier 584. The output of amplifier 566 is also connected through resistor 586 to capacitor 588, which in turn is connected to the noninverting input of amplifier 584. The output of amplifier 584 is connected through feedback capacitor 590 to the junction formed by resistors 586 and 588. The output cf amplifier 584 is also connected through feedback resistor 592 to its inverting input, the inverting input being connected through resistor 594 to system ground. The output of amplifier 584 forms the output of the equalizer circuits 260. The output of each of the equalizer circuits 260A and 260B are connected to the input matrix 262, also shown in FIG. 17D. The output of amplifier 584A forms the right channel input of the matrix while the output of amplifier 584B forms the left channel input to the matrix.

The right channel output provided by amplifier 584A is connected through resistor 600 to the junction 602.

The left channel input from amplifier 584B is also connected through resistor 604 to the junction 602. By making resistors 600 and 604 of equal value, the left and right signals will be summed at junction 602 so as to represent the L+R signal output of the matrix.

In order to form the L−R signal the left channel signal at the output of amplifier 584A is connected through resistor 606 to the inverting input of amplifier 608. The left channel input from amplifier 584B is connected through resistor 610 to the noninverting input of amplifier 608, the latter input being connected through resistor 612 to system ground. The output of amplifier 608 is connected through feedback resistor 614 to its inverting input. Resistors 606 and 610 are made equal so that the output of amplifier 608 functions as a subtractor and the output of amplifier 608 provides an L−R signal.

The L+R signal provided at junction 602 is applied to the low frequency equalizer control circuit 264, shown in FIGS. 17D and 17E. More particularly, junction 602 is connected to the inverting input of an amplifier 616, the latter having its output connected through feedback resistor 618 through junction 602 to its inverting input. The noninverting input of amplifier 616 is connected through resistor 620 to system ground. The output of amplifier 616 is also connected through resistor 622 to the inverting input of amplifier 624. The latter has its noninverting input connected to system ground and its output connected through resistor 626 to the noninverting input of amplifier 616. The output of amplifier 624 is also connected through feedback capacitor 628 to the inverting input of the amplifier. The output of amplifier 624 is also connected through resistor 630 to the inverting input of amplifier 632. The latter has its noninverting input connected to system ground and its output connected through feedback capacitor 634 to its inverting input. The output of amplifier 632 is connected through feedback resistor 636 to the inverting input of amplifier 616. The output of amplifier 632 is also connected through capacitor 638 to the resistor of potentiometer 640, which in turn is connected to system ground. The output of amplifier 632 is also connected through capacitor 642 to the resistor of potentiometer 644, which in turn is connected to system ground. The junction formed between capacitor 638 and potentiometer 640 is connected to the junction formed by capacitor 642 and potentiometer 644, the two junctions being connected through resistor 646 to the inverting input of amplifier 648 shown in FIG. 17E. The inverting input of amplifier 648 is connected through feedback resistor 650 to the junction formed by resistor 618, shown in FIG. 17D, the output of amplifier 616, and resistor 622. The inverting input of amplifier 648 is also connected through resistor 652 to the wiper arm of potentiometer 644 and through resistor 654 to the wiper arm of potentiometer 640. The noninverting input of amplifier 648 is connected through resistor 656 to the junction formed by the output of amplifier 624 and the resistor 626. The junction formed between resistors 626 and 656 is connected through the resistor of potentiometer 660 to system ground, and through resistor 662 to the wiper arm of the potentiometer 660. The noninverting input of amplifier 648 is connected through resistor 664 to the wiper arm of potentiometer 660 and through resistor 666 to system ground. The wiper arms of potentiometers 644 and 660 are ganged together so as to control the amount of low frequency boost provided by control circuit 264. The output of amplifier 648 is connected through feedback resistor 668 and forms the output of low frequency equalizer control circuit 264. The output of amplifier 648 is therefore connected to the input of the output matrix 268 described hereinafter.

The L−R output of input matrix 262 provided at the output of amplifier 608 is connected to the high frequency equalization control circuit 266, shown in FIG. 17D. The L−R output is applied to a bandpass filter 700. More particularly, the output of amplifier 608 is connected to resistor 702 of filter 700, which in turn is disconnected through capacitor 704 to system ground and through capacitor 706 to the input of the ambience adder/substractor circuit 708, of the high frequency equalization control circuit 266, as shown in FIG. 17E. Capacitor 706 of filter 700 is connected to the resistor of potentiometer 267 of circuit 266, the resistor in turn being connected to system ground. Capacitor 706 is also connected through resistor 710 to the inverting input of amplifier 712. The noninverting input of amplifier 712 is connected to the wiper arm of potentiometer 267. The output of amplifier 712 is connected through feedback resistor 714 to its inverting input. The output of amplifier 712 is connected to the input of the output matrix 268, also shown in FIG. 17E. The L−R output of input matrix 262 shown in FIG. 17D is connected to the input of a low frequency blend circuit 716, shown in FIG. 17D. More particularly, the output of amplifier 608 of matrix 262 is connected through capacitor 718 to the noninverting input of amplifier 720, the latter having its output connected to its inverting input. Capacitor 718 is also connected through resistor 722 to system ground. The low frequency blend circuit 716 is connected to suitable visual display means, wherein the L−R output of matrix 262 is connected to the contact 726 of a switch 730. The junction formed by capacitor 718 and resistor 722 is connected to contact 728 of switch 730, the remaining contact 724 being disconnected. The second switch 732 has one contact 734 disconnected, the second contact 738 connected to port A, and a third contact 736 connected through resistor 740 to a positive voltage supply. A light-emitting diode 742 is connected between the two contacts 736 and 738. The light-emitting diode 742 indicates that low frequency blend circuit is working. Switches 732 and 724 are ganged together so that in one position a short circuit through contacts 726 and 728 around capacitor 718 is provided and the light-emitting diode 742 is disconnected, and in a second position the two components are connected as shown. The output of the low frequency blend circuit 716 formed by the amplifier 720 is connected to output matrix 268, shown in FIG. 17E.

Specifically, in order to form the left channel output signal L, from matrix 268 the output of amplifier 648 is connected through resistor 750 to a second resistor 752, which in turn is connected to the left channel output of the matrix, indicated at junction 754. The output of amplifier 712 of circuit 708 is connected through resistor 756 to the inverting input of amplifier 758, the inverting input of the amplifier also being connected to the junction of resitors 750 and 752. Finally, the output of amplifier 720 of FIG. 17D is connected through resistor 760 to the noninverting input of amplifier 758 and through resistor 762 to system ground. The output of amplifier 758 is connected to the junction 754 to provide the L signal output of the output matrix 268. In order to form the right channel signal R, the output of amplifier 648 is connected through resistor 764 to the inverting input of amplifier 766, the inverting input having its output connected to junction 769 for providing the right channel signal output of matrix 268. The output of amplifier 766 is connected through feedback resistor 768 to its inverting input. The output of amplifier 720 of the low frequency blend circuit 716 shown in FIG. 17D is connected through resistor 770 to the inverting input of amplifier 766. Finally, the output of amplifier 712 of circuit 708 is connected through resistor 772 to the noninverting input of amplifier 766 and through resistor 774 to system ground. Each of the junctions 754 and 770 forming the two outputs of output matrix 268 is connected to each of the parallel connected capacitors 780 and 782, the capacitors being connected together to resistor 784. Resistor 784 in turn is connected to the signal input of a voltage control amplifier 270. The latter is preferably any one of the type manufactured and sold by DBX, INC., of the Newton, Mass. and those described in U.S. Pat. No. 3,714,462, issued to David E. Blackmer on Jan. 30, 1973. Generally, the voltage control amplifier provides an output signal as a logarithmic function of either one of two control signals provided at its two control input terminals 786 and 788. Control terminal 786 is connected to receive a control signal from the power monitor circuit 280, shown in detail in FIG. 17H, while control input terminal 788 is adapted to receive a control signal from the respective ports G and H from the autobalance circuit 258, shown in detail in FIG. 17C. Referring to FIG. 17E, the output of voltage control amplifier 270 is connected to the inverting input of the amplifier 790. The latter has its noninverting input connected to system ground and its output connected through capacitor 792 and through resistor 794 to its inverting input.

Figure 17F:
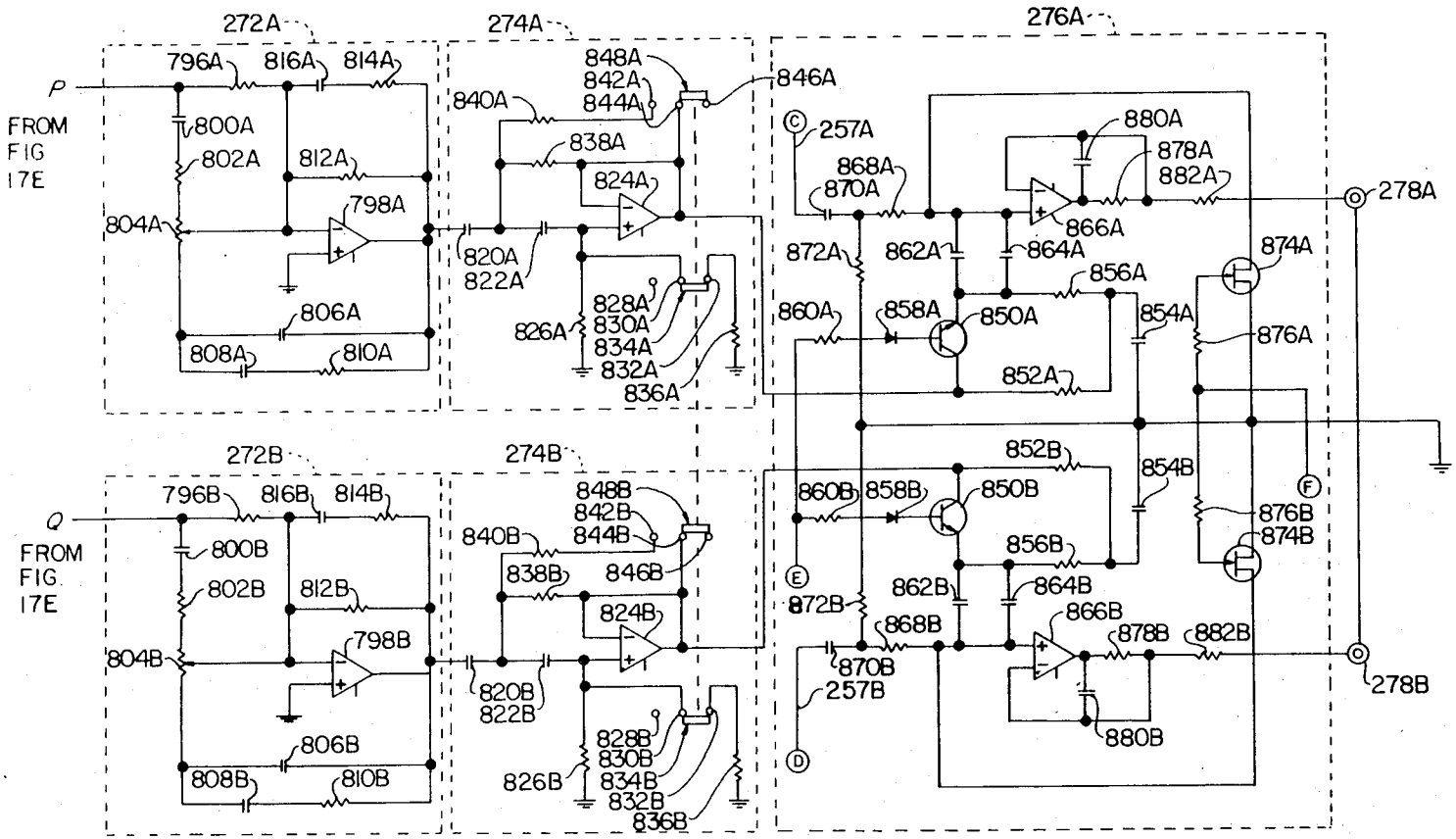

The output of amplifier 790 is connected to the input of the high frequency tone control circuit 272, shown in detail in FIG. 17F. In particular, the output of amplifier 790 is connected to resistor 796, which in turn is connected to the inverting input of amplifier 798. The output of amplifier 790 is also connected to capacitor 800, which in turn is connected through resistor 802 to the resistor of potentiometer 804. The opposite side of the resistor of potentiometer 804 is connected through the feedback capacitor 806 to the output of amplifier 798 and through the capacitor 808 to resistor 810, which in turn is connected to the output of amplifier 798. The noninverting input of amplifier 798 is connected to system ground, while the inverting input of the amplifier is connected to the wiper arm of potentiometer 804. The output of amplifier 798 is connected through feedback capacitor to its inverting input. The output of amplifier 798 is also connected to feedback resistor 814 to capacitor 816, which in turn is connected to the inverting input. The output of amplifier 798 forms the output of the circuit 272 and is connected to the input of the high-pass filter 274, also shown in detail in FIG. 17F.

More particularly, the output of amplifier 798 of the circuit 272 is connected to capacitor 820, which in turn is connected to capacitor 822. The latter is connected to the noninverting input of amplifier 824 and to resistor 826. Resistor 826 in turn is connected to system ground. The junction of capacitor 822 and resistor 826 is connected to contact 830 of switch 834. The contact 828 of switch 834 remains unconnected while the contact 832 is connected through resistor 836 to system ground. Capacitor 820 at the input of filter 274 is also connected through resistor 838 to the inverting input of amplifier 824 and through resistor 840 to contact 842 of switch 848. Contact 846 of switch 848 remains disconnected, while contact 844 is connected to the output of amplifier 824. The output of amplifier 824 is connected to its inverting input. Switches 834 and 848 are ganged together for both channels, wherein in one position of the switches resistor 840 is connected in the circuit 274 and resistor 836 is disconnected from the circuit, and in the other position resistor 840 is disconnected and resistor is connected. The output of amplifier 824 forms the output of the filter 274. The output of the filter and amplifier 824 is connected to the input of the output and auto by-pass switch circuit 276, shown in detail in FIG. 17F.

More particularly, the output of amplifier 824 of filter 274 is connected to the collector of transistor 850 of the circuit 276 and to resistor 852, which in turn is connected through capacitor 854 to system ground. The junction of resistor 852 and capacitor 854 is connected through resistor 856 to the emitter of transistor 850. The base of transistor 850 is connected to the cathode of diode 858, which in turn has its anode connected through resistor 860 to the port E, the latter being provided with a signal from the auto by-pass circuit 282, shown in detail in FIGS. 17G and 17I. In this regard, resistors 860A and 860B are tied together to port E. The emitter of transistor 850 is also connected through each of the capacitors 862 and 864 to the noninverting input of amplifier 866. The latter in turn is connected through resistor 868 to the capacitor 870, the latter being connected to port C for the right channel path 257A and port D for the left channel path 257B, for receiving the respective outputs from the input buffers 254, shown in FIG. 17A. The junction of resistor 868 and capacitor 870 is connected through resistor 872 to system ground. The noninverting input of amplifier 866 is also connected to one electrode of an FET transistor 874 which has its other electrode connected to system ground. The gate of transistors 874A and 874B of both channels are connected each through the resistor 876 to a common junction 878 to the port F, the latter being connected to a suitable power source. Finally, the output of amplifier 866 is connected through each of a resistor 878 and a capacitor 880 to resistor 882. The respective resistors 882A and 882B are in turn connected respectively to the right channel output terminal 278A, which in turn is connected to the right channel of a system preamplifier (not shown), and the left channel output terminal 278B, which in turn is connected to the left channel of the system preamplifier.

Figure 17G:
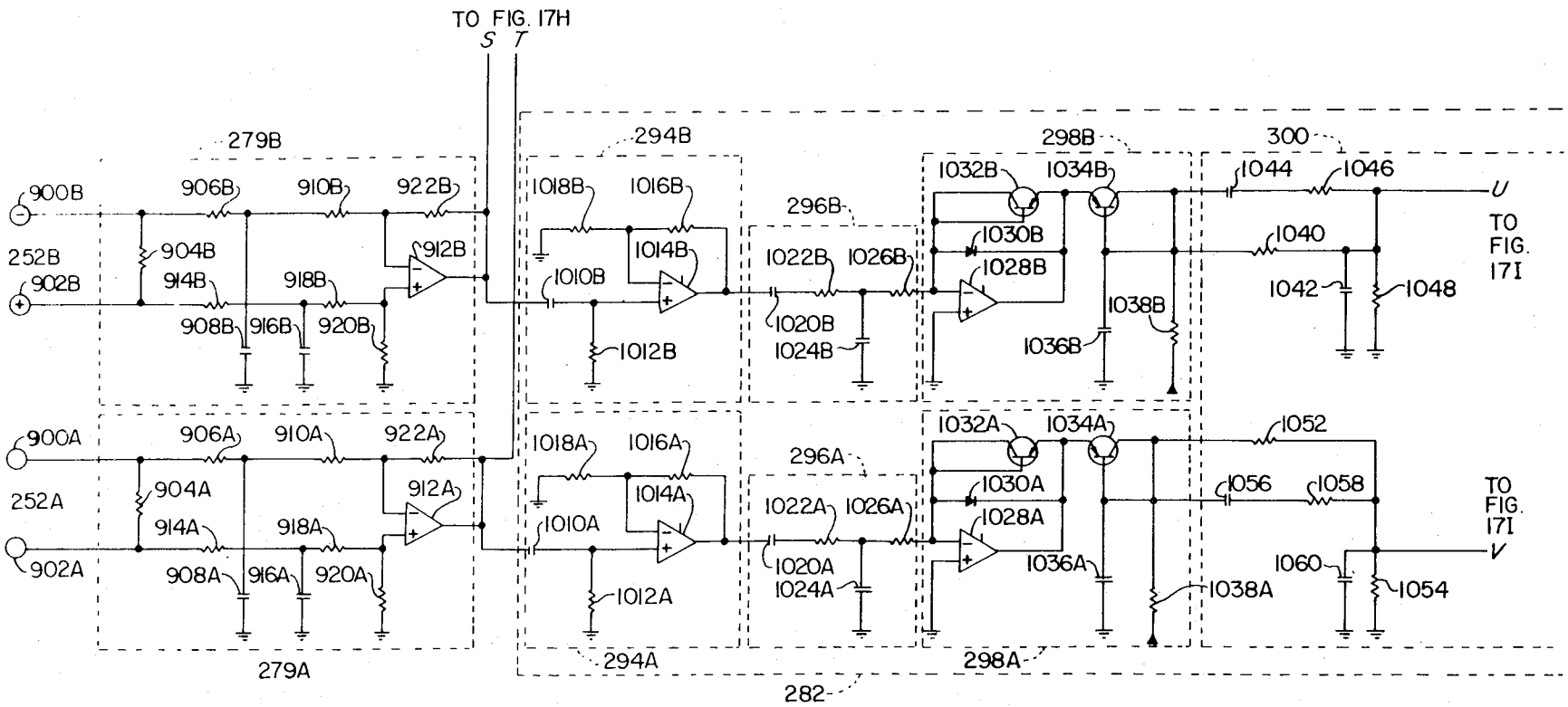

The preferred embodiment of the control path of the system of FIG. 16 will now be described in detail. Referring to FIG. 17G, each channel input 252 has a pair of input terminals, the negative input terminal 900 and the positive input terminal 902. The two input terminals form the input of the balance to single-ended converter 279. Terminal 900 is connected through parallel resistor 904 to the positive input terminal 902. Terminal 900 is also connected through resistor 906 to the capacitor 908, which in turn is connected to system ground. Resistor 906 is also connected through resistor 910 to the inverting input of amplifier 912. The terminal 902 is connected through resistor 914 to the capacitor 916, which in turn is connected to system ground. Resistor 914 is also connected through resistor 918 to the noninverting input of amplifier 912. The noninverting input of amplifier 912 is also connected through resistor 920 to system ground. The output of amplifier 912 is connected through feedback resistor 922 to its inverting input. The output of amplifier 912 forms the output of the converter and is connected to the input of the power monitor circuit 280 (shown in detail in FIG. 17H) and to the input of the auto by-pass circuit 282 (shown in detail in FIGS. 17G and 17I).

Figure 17H:
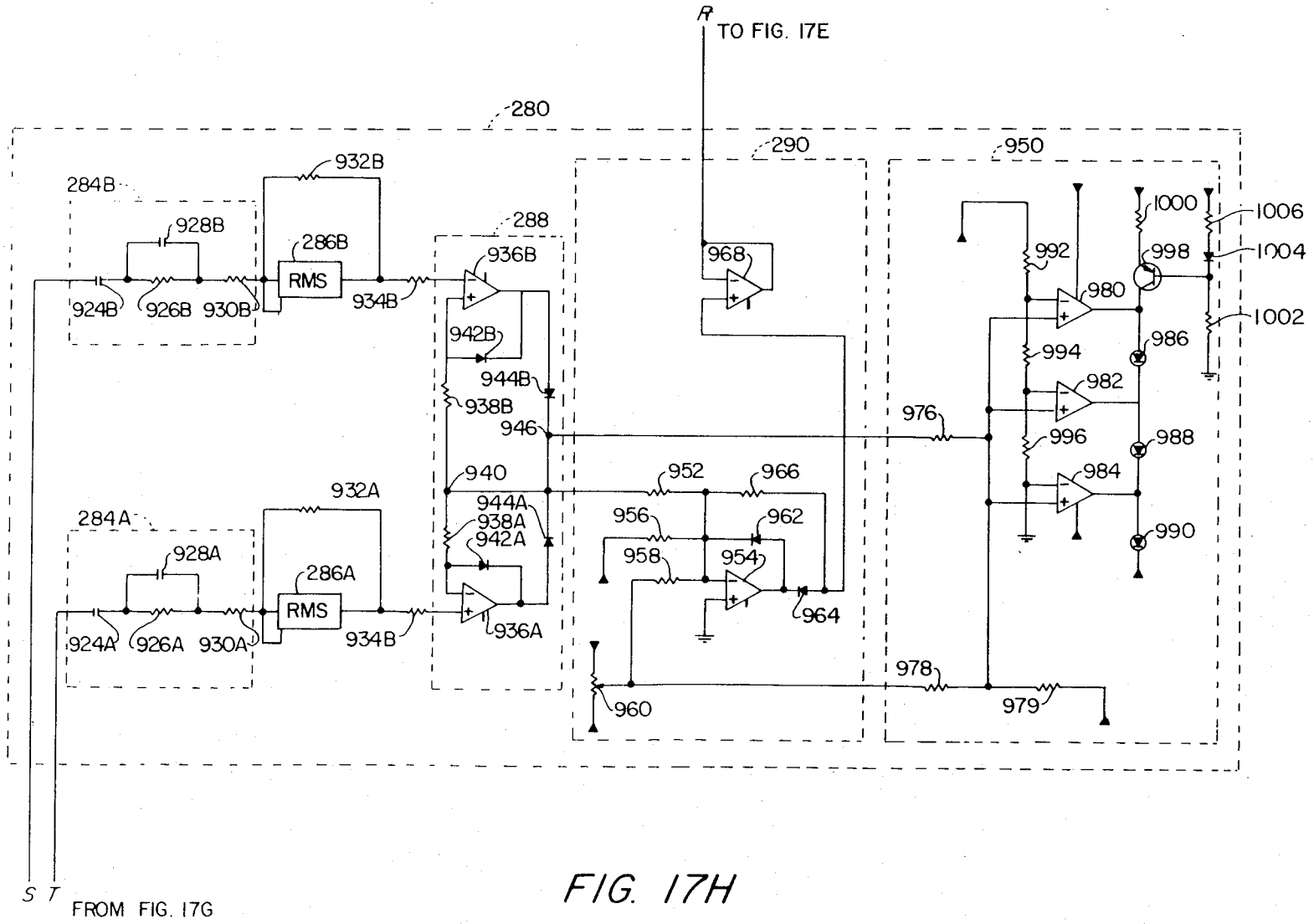

More particularly, referring to FIG. 17H, the output of amplifier 912 of each converter 279 (shown in FIG. 17G) is connected to the input of power monitor circuit 280 by connecting the output of the amplifier to the input of frequency weighting filter 284. The input of filter 284 includes capacitor 924, which in turn is connected to each of the resistor 926 and capacitor 928. The resistor 926 and capacitor 928 are in turn connected together to the resistor 930. The resistor 930 in turn forms the output of filter 284 and is connected to the input of the level detector 286. As previously described, detector 286 is preferably an RMS detector for providing a DC output signal as a function of the RMS value of the input signal. The resistor 932 is preferably connected between the input and output of each detector while the output of the detector 286 is connected through resistor 934 to the input of the greater of the two circuit 288. Resistor 934 is in turn connected to the noninverting input amplifier 936, which has its inverting input connected through resistor 938 to the junction 940. Junction 940 is common for both channels. The inverting input of amplifier 936 is connected to the anode of diode 942, the latter having its cathode connected to the output of the amplifier. Amplifier 936 has its output also connected to the anode of diode 944 which in turn has its cathode connected to the junction 946 common to both channels. The junctions 940 and 946 are respectively connected to the power threshhold detector 290 and the display 950. More particularly, junction 940 is connected to resistor 952 of the detector 290. Resistor 952 in turn is connected to the inverting input of amplifier 954. Amplifier 954 has its inverting input also connected through resistor 956 to a voltage source and through resistor 958 to the wiper arm of potentiometer 960. The noninverting input of amplifier 954 is connected to system ground, while its output is connected to the anode of a diode 962. The cathode of diode 962 is connected to the inverting input of amplifier 954. The output of amplifier 954 is also connected to the cathode of diode 964, which in turn has its anode connected through resistor 966 to the inverting input of the amplifier. The anode of diode 964 is connected to the noninverting input of amplifier 968, the latter having its output connected to its inverting input. The inverting input and output of amplifier 968 is connected to the control input 786 of each of the gain control circuits 270A and 270B, as shown in FIG. 17E.

The junction 946 of the greater of the two circuit 288 is connected to the input resistor 976 of the display 950, shown in FIG. 17H. Resistor 976 is in turn connected through resistor 978 to the wiper arm of potentiometer 960 of the threshhold detector 290. Resistor 976 is also connected to the noninverting input of each of the amplifiers 980, 982, and 984. The latter are for driving the light-emitting diodes 986, 988, and 990. Accordingly, a negative voltage source is connected through resistor 992 to the inverting input of amplifier 980. The resistor 992 in turn is connected through resistor 994 to the inverting input of amplifier 982. Resistor 994 in turn is connected through resistor 996 to the inverting input of amplifier 984. The inverting input of amplifier 984 is in turn connected to system ground. The output of amplifier 980 is connected to the anode of diode 986, which in turn has its cathode connected to the output of amplifier 982. The output of amplifier 982 has its output connected to the anode of diode 988, which in turn has its cathode connected to the output of amplifier 984. Finally, the output of amplifier 984 is connected to the cathode of diode 990 which in turn has its cathode connected to a suitable voltage source. The output of amplifier 980 is also connected to the collector of transistor 998 which has its emitter connected to resistor 1000, the latter being biased by a voltage source. The base of transistor 998 is in turn connected through resistor 1002 to system ground, and to the cathode of diode 1004. The anode of diode 1004 is connected through resistor 1006 to a voltage source.

Referring again to FIG. 17G, The output of each double to single ended converter 279 is also connected to the input of the auto by-pass circuit 282. More particularly, the output of amplifier 912 is connected to the input capacitor 1010 of gain stage 294 of circuit 282. Capacitor 1010 is in turn connected through resistor 1012 to system ground. Capacitor 1010 is also connected to the noninverting input of amplifier 1014. The output of amplifier 1014 is connected through resistor 1016 to the inverting input of the amplifier, the inverting input being connected through resistor 1018 to system ground. The output of amplifier 1014 is connected through capacitor 1020 of the filter 296 to resistor 1022, which in turn is connected to capacitor 1024. The latter is connected to system ground. Resistor 1022 is also connected through resistor 1026 to the inverting input of amplifier 1028 of signal averaging detector 298. The noninverting input of amplifier 1028 is connected to system ground, while its inverting input is connected to the anode of diode 1030. The cathode of diode 1030 is connected to the output of the amplifier. The output of amplifier 1028 is in turn connected to the emitter of transistor 1032, which in turn has its collector and base connected together and to the inverting input of amplifier 1028. The emitter of transistor 1032 is connected to the emitter of transistor 1034. The collector and base of transistor 1034 are connected together and connected through the capacitor 1036 to system ground and through resistor 1038 to a voltage source. The base and collector of transistor 1034 are connected to the resistor 1040, which in turn is connected through capacitor 1042 to system ground. The base and collector of transistor 1034 are also connected through capacitor 1044 to resistor 1046. The latter in turn is connected to the junction formed by capacitor 1042 and resistor 1048. Resistor 1048 in turn is connected to system ground. The junction of resistors 1046 and 1048 are connected to the inverting input of amplifier 1050, shown in FIG. 17I.

Referring still to FIG. 17G, the output of averaging detector 298A at the base collector connection of transistor 1034A is connected through resistor 1052 to the resistor 1054. The latter in turn is connected to system ground. The base and collector of transistor 1034A is also connected through capacitor 1056 to the resistor 1058. The latter in turn is connected to resistor 1054 to system ground and through capacitor 1060 to system ground. The junction of resistor 152, resistor 1058, resistor 1054, and capacitor 1060 is connected to the inverting input of a second amplifier 1062, shown in FIG. 17I.

Figure 17I:
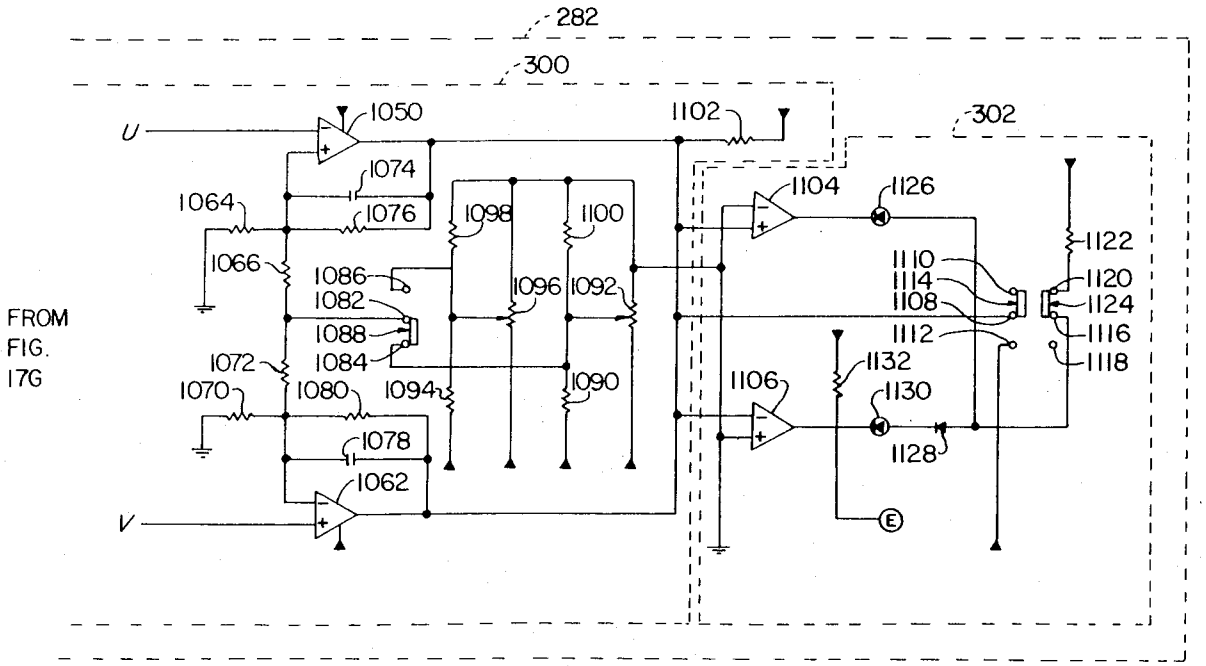

Referring to FIG. 17I, the noninverting input of amplifier 1050 is connected through resistor 1064 to system ground, and through resistor 1066 to junction 1068. The noninverting input of amplifier 1062 is connected through resistor 1070 to system ground, and through resistor 1072 to junction 1068. The output of amplifier 1050 is connected through each of the feedback capacitor 1074 and feedback resistor 1076 to its noninverting input. In a similar manner, amplifier 1062 has its output connected through each of a feedback capacitor 1078 and feedback resistor 1080 to its noninverting input. Junction 1068 is connected to one contact 1082 of the switch 1088. Contact 1084 of switch 1088 is connected through resistor 1090 to a voltage source and to a wiper arm of potentiometer 1092. The contact 1086 of switch 1088 is connected through resistor 1094 to a voltage source and to the wiper arm of potentiometer 1096. Contact 1086 of switch 1088 is also connected through resistor 1098 to one side of the resistor of potentiometer 1096, the other side being connected to a voltage source. Resistor 1098 is also connected through resistor 1100 to the wiper arm of potentiometer 1092. Resistor 1098 is also connected to one system ground. The switch 1088 is thus movable between one position wherein the resistors 1094 and 1098 and potentiometer 1096 are connected in the circuit and a second position wherein the resistors 1090 and 1100 and potentiometer 1092 are connected in the circuit.

The outputs of the two amplifiers 1050 and 1062 are connected together and to resistor 1102 which in turn is connected to a voltage source. The output of the comparator 300, formed by the connection of the common connection of the outputs of amplifiers 1050 and 1062, is connected to the noninverting input of amplifier 1104 and the inverting input of amplifier 1106. The inverting input of amplifier 1104 and the noninverting input of amplifier 1106 are connected to system ground. The output of the comparator 300 is also connected to the contact 1108 of switch 1114. Contact 1110 of the switch is disconnected, while contact 1112 of the switch is connected to a suitable voltage source. A second switch 1116 has its contact 1118 disconnected and its contact 1120 connected through resistor 1122 to a suitable voltage source. The third contact 1124 is connected to the cathode of a light-emitting diode 1126, the latter having its cathode connected to the output of amplifier 1104. The contact 1124 of switch 1116 also is connected to the cathode of a diode 1128, which in turn has its cathode connected to the anode of a light-emitting diode 1130. Diode 1130 in turn has its cathode connected to the output of amplifier 1106 and to the resistor 1132 to a suitable voltage source. The output of amplifier 1106 is connected directly to port E, the latter being connected to the resistors 860A and 860B of the output circuit 276.

In the preferred embodiment of the system shown in FIGS. 17A–17I, the resistors and capacitors have the values shown in the following TABLE B, with resistors being indicated by the prefix R and their values in ohms and the capacitors being indicated by the prefix C and their values in farads. The letter "K" indicates kilohms, "M" indicates megaohms, uf indicates microfarads, "nf" indicates nanofarads and "pf" indicates picofarads.

TABLE B

| Element | Value |
|---|---|
| INPUT BUFFER 254A,B | |
| R326A,B | 220 |
| C330A,B | 100pf |
| R332A,B | 220 |
| R334A,B | 1K |
| C336A,B | 0.1uf |
| R338A,B | 1M |
| C348A,B | 100pf |
| R350A,B | 1M |

TABLE B-continued

| Element | Value |
|---|---|
| R352A,B | 1M |
| C354A,B | 100pf |
| R356A,B | 1M |
| C358A,B | 0.1uf |
| R362A,B | 1M |
| LOW PASS FILTER 256A,B | |
| R366A,B | 27K |
| R373A,B | 33K |
| R374A,B | 18K |
| C378A,B | 680pf |
| R390A,B | 16K |
| C392A,B | 220pf |
| C394A,B | 0.1uf |
| R396A,B | 33K |
| C398A,B | 0.1uf |
| C400A,B | 0.1uf |
| R402A,B | 270K |
| R406A,B | 18K |
| AUTO BALANCE CIRCUIT 258 | |
| C410A,B | 0.1uf |
| R412A,B | 20K |
| C422A,B | 470uf |
| R424A,B | 1.8M |
| R426A,B | 1M |
| R430 | 1M |
| C432 | 100pf |
| R434 | 1M |
| C436 | 10nf |
| R438 | 1K |
| C442 | 0.1uf |
| R448 | 16K |
| R450 | 2K |
| R452 | 470K |
| R454 | 20K |
| C464 | 0.1uf |
| R466 | 10K |
| R470 | 4.7M |
| R472 | 20K |
| R474 | 10K |
| R476 | 47 |
| EQUALIZER 260A,B | |
| R508A,B | 15K |
| R510A,B | 33K |
| C512A,B | 3.3nf |
| R516A,B | 240K |
| R518A,B | 240K |
| R520A,B | 8.2K |
| R522A,B | 470 |
| R524A,B | 2.2K |
| C526A,B | 0.1uf |
| C528A,B | 470pf |
| R530A,B | 56K |
| R532A,B | 12K |
| R534A,B | 10K |
| C538A,B | 4,7nf |
| R540A,B | 27K |
| R542A,B | 10K |
| C544A,B | 4.7nf |
| R546A,B | 10K |
| R548A,B | 2.2K |
| R552A,B | 15K |
| R554A,B | 15K |
| C556A,B | 10nf |
| R560A,B | 12K |
| R562A,B | 10K |
| C564A,B | 2.2nf |
| R568A,B | 91K |
| R570A,B | 91K |
| R572A,B | 750 |
| C574A,B | 33nf |
| R576A,B | 3.9K |
| R578A,B | 7.5K |
| R580A,B | 16K |
| C582A,B | 2.2nf |
| R586A,B | 62K |
| R588A,B | 62K |
| C590A,B | 15nf |
| R592A,B | 510 |
| R594A,B | 10K |
| INPUT MATRIX 262 | |

TABLE B-continued

| Element | Value |
|---|---|
| R600 | 7.5K |
| R604 | 7.5K |
| R606 | 10K |
| R610 | 10K |
| R612 | 10K |
| R614 | 10K |
| LOW FREQUENCY EQUALIZER CONTROL CIRCUIT 264 | |
| R618 | 7.5K |
| R620 | 750 |
| R622 | 39K |
| R626 | 10K |
| C628 | 0.1uf |
| R630 | 39K |
| C634 | 0.1uf |
| R636 | 10K |
| C638 | 0.1uf |
| R640 | 20K |
| C642 | 4.7uf |
| R644 | 10K |
| R646 | 47K |
| R650 | 33K |
| R652 | 3K |
| R654 | 4.7M |
| R656 | 150K |
| R660 | 10K |
| R662 | 3K |
| R664 | 10K |
| R666 | 4.3K |
| R668 | 33K |
| HIGH FREQUENCY EQUALIZER CONTROL CIRCUIT 266 | |
| R702 | 6.8K |
| C704 | 15nf |
| C704 | 0.1uf |
| R710 | 47K |
| R714 | 47K |
| R267 | 10K |
| C718 | 0.15uf |
| R722 | 10K |
| R740 | 2.2K |
| OUTPUT MATRIX 268 | |
| R750 | 10K |
| R752 | 10K |
| R756 | 5.1K |
| R760 | 10K |
| R762 | 3.3K |
| R764 | 10K |
| R768 | 10K |
| R770 | 10K |
| R772 | 5.1K |
| R774 | 10K |
| GAIN CONTROL 270 | |
| C780A,B | 0.1uf |
| C782A,B | 4.7uf |
| R784A,B | 16K |
| C792A,B | 100pf |
| R794A,B | 16K |
| HIGH FREQUENCY TONE CONTROL 272A,B | |
| R796A,B | 5.1K |
| C800A,B | 10nf |
| R802A,B | 470 |
| R804A,B | 10K |
| C806A,B | 15nf |
| C808A,B | 47nf |
| R810A,B | 2.7K |
| R812A,B | 5.1K |
| R814A,B | 2.7K |
| C816A,B | 47nf |
| HIGH PASS FILTER 274A,B | |
| C820A,B | 0.1uf |
| C822A,B | 0.1uf |
| R826A,B | 680K |
| R836A,B | 200K |
| R838A,B | 24K |
| R840A,B | 24K |
| OUTPUT AUTO-BYPASS SWITCH CIRCUIT 276A,B | |
| R852A,B | 220K |
| C854A,B | 4.7uf |
| R856A,B | 220K |
| R860A,B | 47K |

TABLE B-continued

| Element | Value |
|---|---|
| C862A,B | 4.7uf |
| C864A,B | 0.1uf |
| R868A,B | 6.8K |
| C870A,B | 22 |
| R872A,B | 220K |
| R876A,B | 1M |
| C880A,B | 100pf |
| R882A,B | 220 |
| BALANCED TO SINGLE ENDED CONVERTER 279A,B | |
| R904A,B | 1K |
| R906A,B | 1K |
| C908A,B | 220pf |
| R910A,B | 10K |
| R914A,B | 1K |
| C916A,B | 220pf |
| R918A,B | 10K |
| R920A,B | 1.5K |
| R922A,B | 1.5K |
| POWER MONITOR CIRCUIT 280 | |
| FILTER 284A,B | |
| C924A,B | 0.1uf |
| R926A,B | 68K |
| C928A,B | 1nf |
| R930A,B | 33K |
| LEVER DETECTOR 286A,B | |
| R932A,B | 22M |
| R934A,B | 100 |
| GREATER OF THE TWO CIRCUIT 288 | |
| R938A,B | 100 |
| POWER THRESHOLD DETECTOR 290 | |
| R952 | 10K |
| R956 | 680K |
| R958 | 1M |
| R960 | 20K |
| R966 | 10K |
| POWER DISPLAY 950 | |
| R976 | 10K |
| R978 | 1M |
| R992 | 2.7M |
| R994 | 100K |
| R996 | 6.8K |
| R1000 | 120 |
| R1002 | 47K |
| R1006 | 10K |
| AUTO BY-PASS CIRCUIT 282 | |
| GAIN STAGE 294A,B | |
| C1010A,B | 47nf |
| R1012A,B | 100K |
| R1016A,B | 33K |
| R1018A,B | 1K |
| FILTER 296A,B | |
| C1020A,B | 0.15uf |
| R1022A,B | 18K |
| C1024A,B | 2.2nf |
| R1026A,B | 10K |
| AVERAGE DETECTOR 298A,B | |
| C1036A,B | 47uf |
| R1038A,B | 20K |
| COMPARATORS 300A,B | |
| R1040 | 330K |
| C1042 | 0.47uf |
| C1044 | 4.7uf |
| R1046 | 150K |
| R1048 | 330K |
| R1052 | 330K |
| R1054 | 330K |
| C1056 | 4.7uf |
| R1058 | 330K |
| C1060 | 0.47uf |
| R1064 | 330 |
| R1066 | 20K |
| R1070 | 330 |
| R1072 | 20K |
| C1074 | 10nf |
| R1076 | 100K |
| C1078 | 10nf |
| R1080 | 100K |
| R1090 | Infinite |

TABLE B-continued

| Element | Value |
|---|---|
| R1092 | 20K |
| R1094 | Infinite |
| R1096 | 20K |
| R1098 | Infinite |
| R1100 | Infinite |
| R1102 | 4.7K |
| DISPLAY 302 | |
| R1122 | 2.2K |
| R1132 | 4.7K |

In operation, the system shown in FIGS. 17A–17I substantially balances the signal energy level between the two audio channels over a long period of time. This is achieved by the utilization of the auto-balance circuit 258 with the switches 456 and 478 in the position shown. Circuit 258 compares the signal energy levels in each of the channels provided from the filters 256A and 256B. The latter are designed to pass the signal energy within the audio range between about 20 Hz and 20 Khz, while eliminating undesirable noise outside this range. Each of the signal averaging detectors 408A and 408B provide output signals which are a function of the average power detected in each of the respective channels over a relatively long period of time. The two outputs of the detectors 408 are compared by the operational amplifier 428 and a difference signal is provided. If the output of amplifier 428 is positive then the average signal energy is greater in the left channnel than the right channel, and if negative then the average signal energy is greater in the right channel. This differential signal is modified by the operational amplifier 440 and added at port G to control input 788B of gain control circuit 270B, and inverted by the amplifier 468 and added at port H to control input 788A of gain control circuit 270A. The two signals provided at ports G and H are thus approximately equal and opposite in polarity to one another so that the control signals provided at the control inputs 788 of the circuits 270 provide greater attenuation in one channel and less attenuation in the other channel. Adjustment of the potentiometer 472 varies the relative values of the two signals applied to ports G and H so that proper balancing occurs. Where the autotomatic balancing feature is not desired, for example when playing a particular recording, the switches 462 and 478 need only be switch to its other position than the one shown in FIG. 17C.

The system shown in FIGS. 17A–17I also prevents the loudspeakers from being overdriven. This is accomplished by the power monitor 280. More particularly, the two power inputs provided at inputs 252A and 252B in FIG. 17G are transmitted and/or converted by converters 279A and 279B. The output signals of converters 279A and 279B are filtered by the frequency weighting filters 284A and 284B, shown in FIG. 17H. The frequency weighting filters 284 preferentially transmit the signal energy in the middle and high frequency ranges applied to the midrange and tweeter speaker drivers, respectively, since these speaker drivers are more sensitive to excess power than the corresponding woofers. The output of filters 284A and 284B are applied to the RMS level detectors 286A and 286B which provide DC output signals as a function of the RMS value of the respective input signals to the detectors. The DC control output signal of each detector is compared with one another by the greater of the two circuit 288. The latter provide an output signal as a function of the greater of the two signals. This larger signal is compared with the reference level set by potentiometer 960 of the power threshold detector 290. Should the power exceed the level determined by the potentiometer 960, a DC output signal is provided to the buffer amplifier 968, which in turn applies a signal (having a DC value as a function of the signal applied to its noninverting input) to the control inputs 788 of each of the gain control circuits 270A and 270B. As well known in the art, the gain control circuits vary the signal gain impressed on the signals transmitted over each of the main signal paths of each channel in response to and as a function of the amplitude of the DC control signal output of the amplifier 968 of power threshold detector 290. Generally, the greater the level of the DC control signal output the greater the reduction in gain impressed on the main signals by the gain control circuits.

Finally, the system of FIGS. 17A–17I senses the power applied to each of the inputs of the speakers of the stereophonic system and connects the signal paths defined by each set of components 256–276 to the respective outputs 278 when the power applied to at least one of the speakers is at least a predetermined minimum level, and connects the paths 257A and 257B through the respective ports C and D to the outputs 278A and 278B when the power sensed falls below the minimum level. The foregoing is achieved by virtue of the auto by-pass circuit 282, shown in FIGS. 17G and 17I. The circuit 282 senses at inputs 252A and 252B the right and left power signals applied to the respective right and left channel speakers. After the sensed power signals are transmitted and/or converted by the converters 279A and 279B, they are subsequently amplified by the gain stages 294A and 294B. The amplified signals are filtered by the bandpass filters 296A and 296B and applied to the signal averaging level detectors 298A and 298B. Since detectors provide an output of the average power level applied to its input over a long period of time, fast changing signals will not substantially affect the output of the detectors 298A and 298B. So long as the output signals of detectors 298 are above the reference levels set by potentiometer 1092 or potentiometer 1096 of comparators 300 (depending upon the setting of the switch 1088), the latter will provide outputs to the switch driver 302, which in turn increases the signal level applied to port E. As shown in FIG. 17F the signal at port E is applied to the bases of transistors 850A and 850B so that when the signal at port E is at a large enough level the transistors will remain conductive and allow the signal outputs from filters 274A and 274B to be transmitted to the outputs 278A and 278B, while preventing signal paths 257A and 257B from conducting.

However, should the power level drop below a minimum level as determined by potentiometer 1092 or 1096 of the comparators 300A and 300B, the output of level detectors 298A and 298B will fall below the reference levels set for each of the comparators 300A and 300B so that the level of the signal applied to port E falls below the level to maintain transistors 850A and 850B nonconductive. This, however, will connect the signal paths 257A and 257B to the respective outputs 278A and 278B as, for example, when it is desirable to listen to the program on earphones only.

The present invention thus provides an improved loudspeaker system having one or more of the following advantages. A loudspeaker can be easily designed to have both a flat frequency response in all directions and a predetermined power response while using conventional loudspeaker drivers, such as the electromagnetic type. By placing the drivers in predetermined spatial arrays and adjusting the phase and amplitude of the driving signals applied to each driver, the loudspeaker can be made directional in any known manner. Two loudspeakers can be thus adapted to provide specific frequency and power responses so that when oriented relative to one another in a mutually predetermined position they reproduce a stereophonic image substantially independent of the listener's position along a listening line spaced from the loudspeakers and nonintersecting a line extending between the two speakers. The improved cross-over network shown in FIGS. 15A–15C has a substantially constant input impedance as a function of frequency allowing it to be used with any amplifier of sufficient power. The auto-by pass circuit 282 senses the power levels applied to the loudspeakers and insures that the signal paths through components 256–276 only conduct when the sensed power is at least at a predetermined minimum level. The power monitoring circuit 280 prevents the loudspeaker drivers from being overdriven. The auto-balance circuit 258 substantially balances the signal energy levels between two audio channels over a long period of time.

It should be appreciated that each loudspeaker 28 and the cross-over network of FIGS. 15A–15C can be designed to provide any type of radiation dispersion pattern by rearranging the positions of the speaker drivers and/or modifying the components of the cross-over network. For example, where a loudspeaker is used against a wall or in a corner the wall and corner will function as acoustic reflectors so that the radiation dispersion pattern should be modified to account for these reflections and the pattern should conform to the predetermined pattern in the particular position the speaker is placed. However, the frequency response should always be made to be substantially independent of the angle about the vertical axis in any direction within the listening area. Further, although the auto-balance circuit 260 used with the gain control circuit 270, and the auto-bypass circuit 282 used with the auto-bypass switch of circuit 276 have each been described as used for sensing the power input to a loudspeaker, each can be used with any device for receiving audio signals, such as for example, tape recorders.

Since certain changes may be made in the above apparatus without departing from the scope of the invention herein involved, it is intended that all matter contained in the above description or shown in the accompanying drawing shall be interpreted in an illustrative and not in a limiting sense.

What is claimed is:

1. In a signal processing system of the type for use with an audio reproduction system, said signal processing system comprising:

a pair of input terminals for respectively receiving a pair of stereophonic audio input signals;

a pair of output terminals for respectively providing a pair of stereophonic audio output signals;

a pair of signal paths for respectively transmitting said two input signals between said input and output terminals;

means coupled to each of said input terminals for detecting the signal energy levels of each of the corresponding input signals;

means for comparing the detected signal energy levels of said audio input signals and for generating a difference signal in response to and as a function of said comparison; and means responsive to said difference signal and coupled between the system input and output terminals of at least one of said signal paths for varying the signal gain impressed on the input signal transmitted over said at least one path as a function of said difference signal so that said signal energy levels of said output signals are substantially balanced over relatively long periods of time.

2. A system according to claim 1, wherein said means for detecting the signal energy level includes signal averaging detector.

* * * * *

UNITED STATES PATENT AND TRADEMARK OFFICE

CERTIFICATE OF CORRECTION

PATENT NO. : 4,503,554

DATED : March 5, 1985

INVENTOR(S) : Mark F. Davis

It is certified that error appears in the above-identified patent and that said Letters Patent is hereby corrected as shown below:

Claim 2, column 34, line 40, after "energy" please insert -- levels of each of said corresponding input signals -- and after "includes" insert -- a --.

Signed and Sealed this

*Ninth* Day of *July 1985*

[SEAL]

*Attest:*

DONALD J. QUIGG

*Attesting Officer*

*Acting Commissioner of Patents and Trademarks*